US009388635B2

(12) United States Patent
Schroter et al.

(10) Patent No.: US 9,388,635 B2
(45) Date of Patent: Jul. 12, 2016

(54) METHOD AND APPARATUS FOR CONTROLLING AN ORIENTABLE CONNECTION IN A DRILLING ASSEMBLY

(75) Inventors: Terence Allan Schroter, Edmonton (CA); Alben D'Silva, Edmonton (CA); Stephen Daniel Lloyd, Upton Upon Severn (GB); Tim John Cox, Gloucester (GB); Sheldon Kryger, Thorsby (CA)

(73) Assignee: Halliburton Energy Services, Inc., Houston, TX (US)

( * ) Notice: Subject to any disclaimer, the term of this patent is extended or adjusted under 35 U.S.C. 154(b) by 967 days.

(21) Appl. No.: 13/634,998

(22) PCT Filed: May 10, 2010

(86) PCT No.: PCT/CA2010/000706

§ 371 (c)(1),
(2), (4) Date: Sep. 14, 2012

(87) PCT Pub. No.: WO2011/140625

PCT Pub. Date: Nov. 17, 2011

(65) Prior Publication Data

US 2013/0046417 A1 Feb. 21, 2013

Related U.S. Application Data

(63) Continuation-in-part of application No. 12/264,827, filed on Nov. 4, 2008, now Pat. No. 8,322,461.

(51) Int. Cl.

| | |
|---|---|
| ***E21B 7/06*** | (2006.01) |
| ***E21B 7/02*** | (2006.01) |
| ***E21B 47/024*** | (2006.01) |

(52) U.S. Cl.

CPC ..... *E21B 7/067* (2013.01); *E21B 47/024* (2013.01)

(58) Field of Classification Search

None

See application file for complete search history.

(56) References Cited

U.S. PATENT DOCUMENTS 3,252,528 A * 5/1966 Nicolson ..... E21B 7/128 166/350
3,315,742 A * 4/1967 Nicolson ..... E21B 7/128 166/338

(Continued)

FOREIGN PATENT DOCUMENTS

| | | |
|---|---|---|
| CA | 2130282 | 2/1995 |
| CA | 2255299 | 7/1999 |

(Continued)

OTHER PUBLICATIONS

Halliburton 2003 Press Release, "Sperry-Sun continues to lead the industry in rotary steerable technology with the introduction of its Geo-Pilot Series II System", Feb. 20, 2003, 3 pages.

(Continued)

*Primary Examiner* — Mohammad Ali
*Assistant Examiner* — Kelvin Booker
(74) *Attorney, Agent, or Firm* — Terrance N. Kuharchuk; Parlee McLaws LLP; Clive D. Menezes

(57) ABSTRACT

In an apparatus of the type comprising a first assembly, a second assembly, an orientable rotatable connection between the first assembly and the second assembly, and a control device associated with the orientable rotatable connection, a method for controlling the actuation of the control device. Particular embodiments of the method include comparing an actual orientation of the second assembly with a target orientation, actuating the control device to perform a control device actuation cycle if the actual orientation is not acceptable, determining an updated actual orientation of the second assembly, comparing the updated actual orientation with the target orientation, and repeating the control device actuation cycle if the updated target orientation is not acceptable. A first exemplary embodiment of the method represents a target approach to achieving the target orientation. A second exemplary embodiment of the method represents an incremental approach to achieving the target orientation.

40 Claims, 13 Drawing Sheets

(56) References Cited

U.S. PATENT DOCUMENTS 3,713,500 A 1/1973 Russell
3,896,667 A 7/1975 Jeter
3,967,680 A 7/1976 Jeter
4,655,289 A 4/1987 Schoeffler
4,689,620 A 8/1987 Wondrak
4,739,325 A 4/1988 MacLeod
5,113,379 A 5/1992 Scherbatskoy
5,237,540 A 8/1993 Malone
5,249,161 A 9/1993 Jones et al.
5,375,098 A 12/1994 Malone et al.
5,485,889 A 1/1996 Gray
5,493,288 A 2/1996 Henneuse
5,579,283 A 11/1996 Owens et al.
5,679,894 A 10/1997 Kruger et al.
5,803,185 A * 9/1998 Barr ..... E21B 7/06 175/45
5,812,068 A 9/1998 Wisler et al.
5,963,138 A 10/1999 Gruenhagen
6,059,050 A 5/2000 Gray
6,109,370 A 8/2000 Gray
6,138,774 A * 10/2000 Bourgoyne, Jr. ..... E21B 21/001 175/214
6,158,533 A 12/2000 Gillis et al.
6,167,969 B1 1/2001 Schoeffler
6,179,066 B1 * 1/2001 Nasr ..... E21B 17/1014 175/24
6,216,802 B1 4/2001 Sawyer
6,233,524 B1 5/2001 Harrell et al.
6,244,361 B1 6/2001 Comeau et al.
6,247,542 B1 * 6/2001 Kruspe ..... E21B 33/1243 166/66
6,267,185 B1 7/2001 Mougel et al.
6,269,892 B1 8/2001 Boulton et al.
6,272,434 B1 8/2001 Wisler et al.
6,273,190 B1 8/2001 Sawyer
6,279,667 B1 * 8/2001 Culver ..... E21B 7/046 175/19
6,347,674 B1 * 2/2002 Bloom ..... E21B 4/18 175/104
6,382,332 B1 5/2002 Eaton
6,419,033 B1 * 7/2002 Hahn ..... E21B 7/062 175/171
6,443,228 B1 * 9/2002 Aronstam ..... E21B 47/12 166/250.11
6,467,557 B1 * 10/2002 Krueger ..... E21B 4/18 175/104
6,478,096 B1 * 11/2002 Jones ..... E21B 44/00 166/250.01
6,513,606 B1 2/2003 Krueger
6,571,888 B2 6/2003 Comeau et al.
6,595,296 B1 * 7/2003 French ..... E21B 23/006 166/321
6,668,935 B1 * 12/2003 McLoughlin ..... E21B 23/006 166/320
6,871,713 B2 * 3/2005 Meister ..... E21B 44/00 166/250.01
6,978,850 B2 12/2005 Sawyer
7,258,171 B2 * 8/2007 Bourgoyne ..... E21B 23/006 166/348
7,324,907 B2 1/2008 Joublin et al.
7,543,658 B2 6/2009 Russell et al.
2002/0060094 A1 * 5/2002 Meister ..... E21B 44/00 175/50
2002/0140573 A1 10/2002 Carstensen et al.
2002/0153136 A1 * 10/2002 Kruspe ..... G01V 3/32 166/250.01
2003/0010534 A1 1/2003 Chen et al.
2003/0016164 A1 1/2003 Finke et al.
2003/0026169 A1 2/2003 Schultz
2003/0034178 A1 * 2/2003 Cargill ..... E21B 7/067 175/73
2003/0056963 A1 3/2003 Wenzel
2003/0071617 A1 * 4/2003 Kruspe ..... G01V 3/32 324/303
2003/0142586 A1 7/2003 Shah et al.
2004/0032258 A1 * 2/2004 Blumich ..... G01V 3/32 324/303
2004/0099443 A1 * 5/2004 Meister ..... E21B 44/00 175/58
2004/0129423 A1 * 7/2004 Eddison ..... E21B 1/103 166/321
2004/0245016 A1 * 12/2004 Chemali ..... E21B 44/00 175/25
2005/0007259 A1 * 1/2005 Minto ..... G01V 1/40 340/854.3
2005/0034917 A1 * 2/2005 Mathiszik ..... G01V 1/44 181/108
2005/0046587 A1 * 3/2005 Wisler ..... E21B 17/003 340/854.6
2005/0056463 A1 * 3/2005 Aronstam ..... E21B 7/062 175/61
2005/0206378 A1 * 9/2005 Hamdan ..... G01V 3/32 324/303
2005/0209782 A1 * 9/2005 Moriarty ..... E21B 47/18 702/6
2005/0248342 A1 * 11/2005 Rottengatter ..... G01V 3/32 324/303
2006/0017442 A1 * 1/2006 Folberth ..... G01V 13/00 324/334
2006/0033491 A1 * 2/2006 Blanz ..... G01N 24/081 324/303
2006/0132129 A1 * 6/2006 Edwards ..... G01V 3/32 324/303
2006/0157281 A1 * 7/2006 Downton ..... E21B 7/06 175/61
2007/0112521 A1 * 5/2007 Akimov ..... G01V 11/00 702/6
2007/0181343 A1 8/2007 Russell et al.
2008/0202770 A1 * 8/2008 Bolding ..... E21B 34/02 166/386
2008/0297161 A1 * 12/2008 Gorek ..... G01V 3/28 324/342
2009/0058416 A1 * 3/2009 Blanz ..... G01N 24/081 324/303
2009/0125239 A1 * 5/2009 Niemeyer ..... G01N 24/081 702/11
2009/0266614 A1 * 10/2009 Meister ..... E21B 10/32 175/57
2010/0108383 A1 5/2010 Hay et al.
2013/0043076 A1 * 2/2013 Larronde ..... E21B 7/067 175/61

FOREIGN PATENT DOCUMENTS

CA 2195002 6/2000
CA 2418717 8/2004
CA 2446097 5/2005
EP 0636763 2/1995
EP 0744527 11/1996
EP 0617196 6/2000
FR 2777594 10/1999
GB 2333785 8/1999
GB 2356207 5/2001
WO 9715749 5/1997
WO 0065198 11/2000
WO 0111191 2/2001
WO 0212676 2/2002
WO 2009039448 3/2009

OTHER PUBLICATIONS

Sperry-Sun Drilling Services Technology Update, "Coiled Tubing BHA Orienter for Directional and Horizontal Drilling", Winter 1995, 4 pages.
Baker-Hughes Brochure entitled "OrientXPress", 2000, 2 pages.
Schlumberger Brochure entitled "CT Express", Jun. 2001, 2 pages.

* cited by examiner

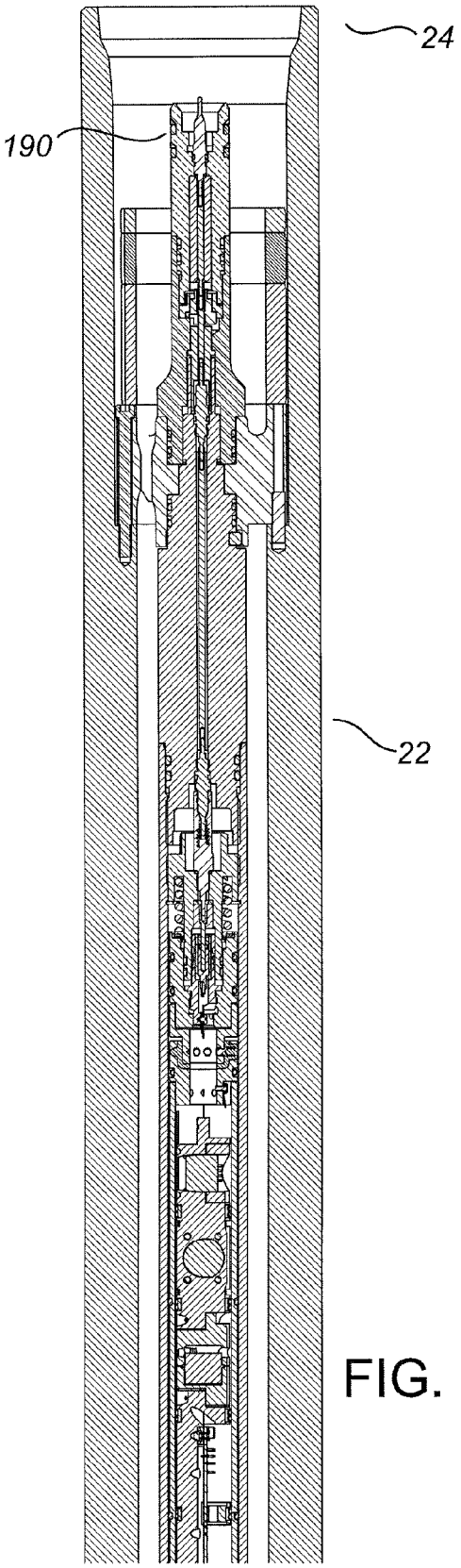
FIG. 7A
FIG. 7B
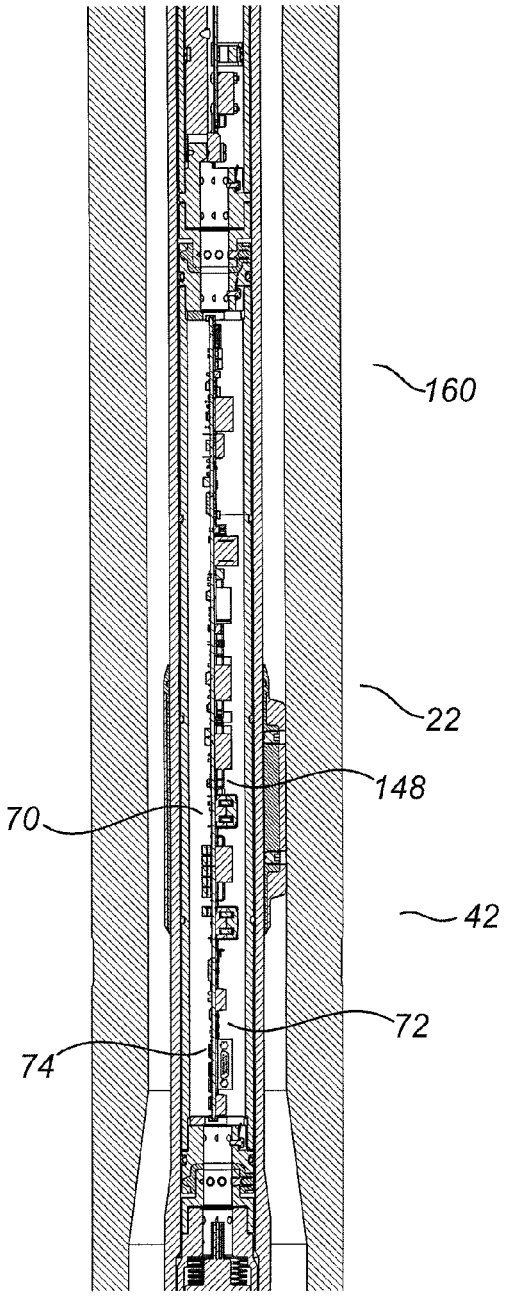

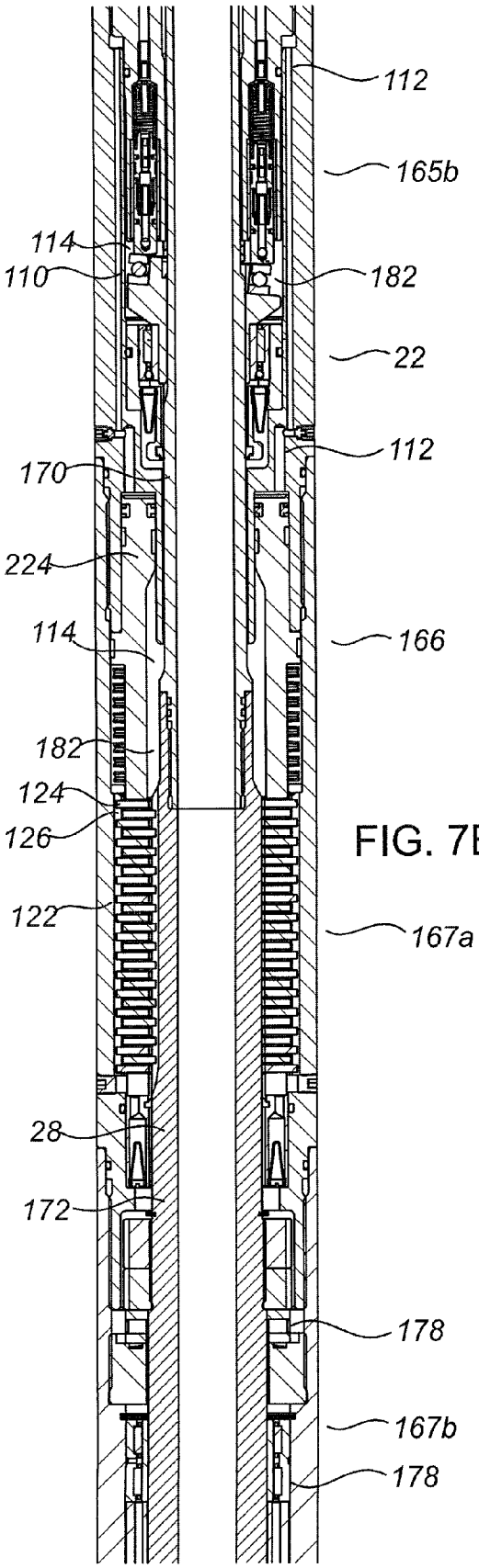
FIG. 7E
FIG. 7F
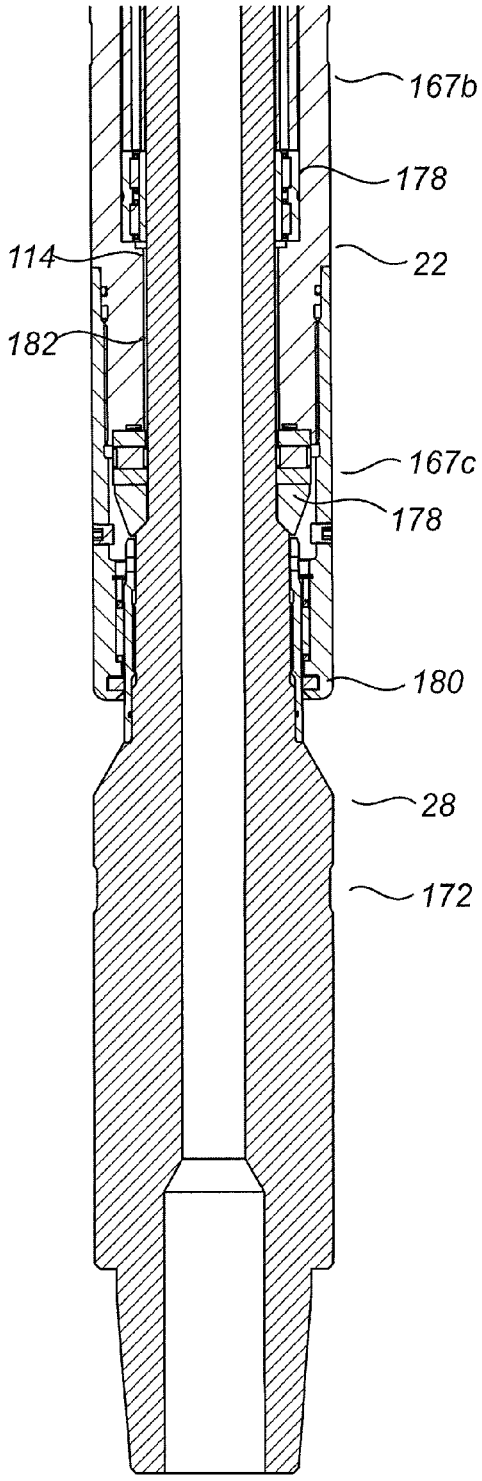

METHOD AND APPARATUS FOR CONTROLLING AN ORIENTABLE CONNECTION IN A DRILLING ASSEMBLY

TECHNICAL FIELD

An apparatus and a control method for controlling the apparatus.

BACKGROUND OF THE INVENTION

Drilling of subterranean boreholes is often performed by rotating a drill bit which is located at a distal end of a drilling string. The drill bit may be rotated by rotating the entire drill string from a surface location and/or by using a rotary drilling motor which is connected with the drilling string and which is located adjacent to the drill bit.

The drilling string may be made up of individual joints of drilling pipe which are connected together to form the drilling string. Alternatively, the drilling string may be made up of a continuous length of coiled tubing which is stored on a large spool.

When the drilling string is made up of individual joints of drilling pipe, the entire drill string may be rotated with relative ease using a rotary table or a top drive on the drilling rig. When the drilling string is made up of a continuous length of coiled tubing, it is relatively more difficult to rotate the entire drill string because the spool must also be rotated.

Drilling while rotating the drill bit only by rotating the entire drilling string is often referred to as "rotary drilling". Drilling while rotating the drill bit only with a rotary drilling motor is often referred to as "sliding drilling". Drilling while rotating the drill bit both by rotating the entire drilling string and with a rotary drilling motor is often referred to as "performance drilling".

Directional drilling involves "steering" the drill bit so that the drill bit drills along a desired path. Directional drilling therefore requires a mechanism for orienting the drill bit so that it drills along the desired path. The orientation of the drill bit during directional drilling is often referred to as a "toolface orientation".

Directional drilling may be performed using a bend in the drilling string or using a steering tool which is associated with the drilling string.

If directional drilling is performed using a bend in the drilling string, the orientation of the bend must be controlled in order to provide a desired toolface orientation. As a result, steering with a bend in the drilling string may typically only be achieved during sliding drilling, since rotary drilling will result in a constant rotation of the bend and constant variation of the toolface orientation.

If directional drilling is performed using a steering tool, a desired toolface orientation may be achieved either by controlling the actuation of the steering tool or by maintaining the steering device at a fixed actuation and controlling the orientation of the steering tool in a similar manner as performing directional drilling with a bend in the drilling string.

Once selected, the toolface orientation may change in an undesired manner during drilling due to forces applied to the drill bit and the drilling string. These forces may be forces applied to the drill string from the surface location or may be reactive forces exerted on the drill bit and/or the drilling string by the borehole. As a result, it is often desirable to adjust the toolface orientation during directional drilling from time to time to account for such forces and for resulting undesired changes to the toolface orientation.

Reactive torque results from a reaction of the borehole to rotation of the drill bit against the distal end of the borehole. Reactive torque tends to rotate the drill bit in a direction opposite to that which is imposed upon the drill bit by rotation of the drill string and/or by a rotary drilling motor. Reactive torque may cause changes in the toolface orientation and also imposes potentially damaging stresses on the drilling string.

Efforts have been made to provide a drilling apparatus which controls the effects of reactive torque while facilitating directional drilling.

U.S. Pat. No. 5,485,889 (Gray) describes a drilling system and method for use with coiled tubing. The drilling system includes a control device. The control device includes a downstream section which is connected to a drilling tool having a bend axis, an upstream section which is connected to coiled tubing, and a swivel coupling assembly which connects the downstream section and the upstream section. A pump and a circuit are associated with the downstream section, the upstream section and the swivel coupling assembly so that relative rotation between the downstream section and the upstream section causes the pump to pump fluid through the circuit. A flow restricting orifice and a valve are provided in the circuit. The control device may be actuated to form a straight section of a borehole and a curved section of the borehole. In order to form the straight section of the borehole, the control device is actuated to permit relative rotation of the downstream section and the upstream section at a rate which is less than the rate of rotation of the drill bit. In order to form the curved section of the borehole, the control device is actuated to prevent relative rotation of the downstream section and the upstream section, thereby facilitating orientation of the bend axis of the drilling tool. Actuation of the control device to prevent relative rotation of the downstream section and the upstream section is achieved by actuating the valve to a closed position so that circulation of fluid through the circuit is prevented. The valve is actuated from the surface location through a control cable which extends to the surface location. A sensor communicates through the control cable with the surface location in order to communicate unspecified information to the surface location.

U.S. Pat. No. 6,059,050 (Gray) describes an apparatus for controlling relative rotation of a drilling tool due to reactive torque. The apparatus includes a first member and a second member which are relatively rotatable and a hydraulic pump having a first pump part mounted on the first member and a second pump part mounted on the second member. The pump is arranged such that relative rotation of the first and second members causes relative rotation of the first and second pump parts, which results in pumping of hydraulic fluid from a first chamber to a second chamber within which the hydraulic fluid is under pressure. A brake having a first brake part on the first member and a second brake part on the second member is associated with the second chamber such that the brake is actuated by the hydraulic pressure in the second chamber. A duct and a variable orifice control the flow of fluid from the second chamber back to the first chamber, thereby controlling the braking force exerted by the brake and the relative rotation of the first and second members. The apparatus may be actuated to permit or prevent relative rotation of the first and second members. Actuation of the apparatus to prevent relative rotation of the first and second members is achieved by actuating the variable orifice to a closed position so that the flow of fluid from the second chamber back to the first chamber is prevented. The variable orifice is controlled by an electrical control line from a suitable control system. A sensor communicates through the control cable with the surface location in order to communicate unspecified information to the surface location.

U.S. Pat. No. 6,571,888 (Comeau et al) describes an apparatus and a method for directional drilling with coiled tubing. The apparatus includes an uphole sub connected to coiled tubing, a downhole sub having a bent housing, a drill bit and a first motor for rotating the drill bit, a rotary connection between the uphole sub and the downhole sub for enabling rotation therebetween, and a clutch positioned between the rotary connection and the uphole sub. The clutch is operable between engaged and disengaged positions using fluid cycles applied alternately to engage and disengage the clutch. In the engaged position of the clutch, the downhole sub is rotatable relative to the uphole sub. In the disengaged position of the clutch, the downhole sub is locked against rotation relative to the uphole sub. The apparatus may be further comprised of a speed reducer for dissipating the reactive torque tending to rotate the downhole sub when the clutch is in the engaged position.

U.S. Patent Application Publication No. US 2003/0056963 A1 (Wenzel) describes an apparatus for controlling a downhole drilling motor assembly which includes a tubular housing, a mandrel rotatably mounted within the housing, and an hydraulic damper assembly disposed between the housing and the mandrel. The hydraulic damper assembly limits the rate of rotation of the mandrel within the housing in order to provide a preset resistance to reactive torque. The hydraulic damper assembly includes an annular body which is positioned within an annular chamber between the housing and the mandrel. The annular body is connected with the mandrel with splines so that the annular body rotates with the mandrel and can reciprocate axially relative to the mandrel. A guide track on the exterior surface of the annular body engages with guide members on the housing. The guide track has a zig-zag pattern which causes the annular body to reciprocate axially in the annular chamber as the housing rotates relative to the mandrel. The annular chamber is filled with hydraulic fluid. The annular body is provided with hydraulic valves which provide a restricted flow of the hydraulic fluid through the annular body as the annular body reciprocates within the annular chamber, thereby providing the preset resistance which limits the rate of rotation of the mandrel within the housing. The apparatus may be actuated to permit or prevent rotation of the mandrel within the housing. Actuation of the apparatus to prevent rotation of the mandrel within the housing may be achieved by actuating an annular plug to block the hydraulic valves, by actuating a clutch between the mandrel and the housing to lock the mandrel and housing together, or by actuating an electric valve to block the movement of hydraulic fluid within the annular chamber.

BRIEF DESCRIPTION OF DRAWINGS

Embodiments of the invention will now be described with reference to the accompanying drawings, in which:

FIGS. 7A-7F are a longitudinal section assembly drawing of components of an embodiment of the apparatus of the invention, in which FIG. 7B is a continuation of FIG. 7A, FIG. 7C is a continuation of FIG. 7B, FIG. 7D is a continuation of FIG. 7C, FIG. 7E is a continuation of FIG. 7D, and FIG. 7F is a continuation of FIG. 7E.

DETAILED DESCRIPTION

References in this document to dimensions, to orientations, to operating parameters, to ranges, to lower limits of ranges, and to upper limits of ranges are not intended to provide strict boundaries for the scope of the invention, but should be construed to mean "approximately" or "about" or "substantially", within the scope of the teachings of this document, unless expressly stated otherwise.

The present invention relates to an apparatus and to a method for controlling the apparatus.

The apparatus of the present invention may be comprised of a first assembly, a second assembly, an orientable rotatable connection between the first assembly and the second assembly, and a control device associated with the orientable rotatable connection, wherein the control device may be actuatable to selectively allow rotation of the second assembly relative to the first assembly or prevent rotation of the second assembly relative to the first assembly.

In some embodiments, the first assembly may be comprised of an upper assembly, and the second assembly may be comprised of a lower assembly.

The invention utilizes a force or forces exerted on the first assembly and/or the second assembly in order to control the actuation of the control device and thus the relative orientations of the first assembly and the second assembly and/or a rate of relative rotation between the first assembly and the second assembly. The force or forces may be comprised of or may consist essentially of a direct force exerted on one or both of the first assembly and the second assembly, a friction force exerted between the first assembly and the second assembly, a reaction force exerted on one or both of the first assembly and the second assembly, and/or any other force or forces which may tend to cause the first assembly and the second assembly to rotate relative to each other.

In some embodiments, the invention may utilize reactive torque to control the orientation and/or the rotation rate of one or more components of a drilling string during drilling. In such embodiments, the control device may be comprised of a reactive torque control device.

In some embodiments, the invention is particularly useful for controlling a toolface orientation in directional drilling.

As used herein, "upper" means relatively proximal and/or uphole and "lower" means relatively distal and/or downhole with respect to position within a drilling string or location within a borehole, relative to a surface location.

Figure 1:
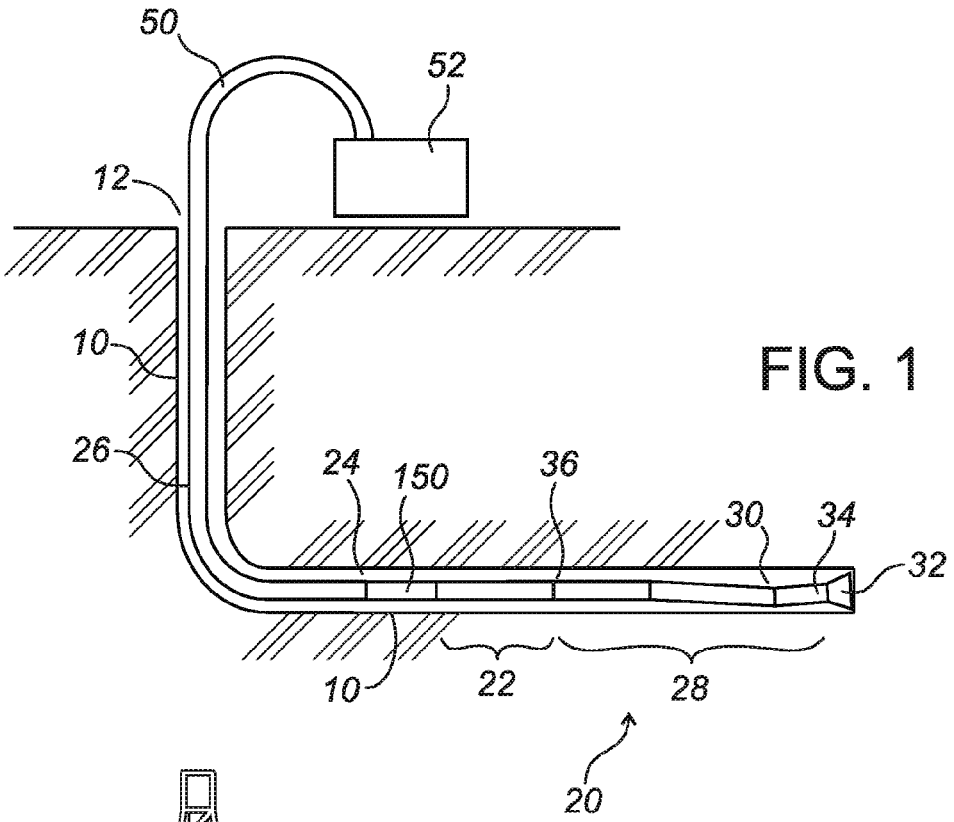
FIG. 1 is a schematic drawing of one embodiment of the apparatus of the invention connected with a drilling string in a borehole.

FIG. 1 provides a basic schematic view of one exemplary configuration of equipment which may be used to drill a borehole (10) from a surface location (12), including a schematic depiction of the apparatus (20) of the invention. The surface location (12) may be a ground surface, a drilling platform, or any other location outside of the borehole (10) from which drilling is controlled.

Referring to FIG. 1, an embodiment of the apparatus (20) of the invention is comprised of an upper assembly (22) as a first assembly. The upper assembly (22) has an upper end (24) which is connected with a drilling string (26).

The apparatus (20) is further comprised of a lower assembly (28) as a second assembly. In the embodiment depicted in FIG. 1, the lower assembly (28) is connected with a drilling assembly or is comprised of a drilling assembly. As depicted in FIG. 1, the lower assembly (28) is comprised of the drilling assembly.

The drilling assembly may be comprised of any tool or apparatus or combination of tools and/or apparatus of the type which may be connected with the drilling string (26) in order to drill the borehole (10). As non-limiting examples, the drilling assembly may include one or more drill collars, stabilizers, drill bits, steering tools, drilling motors, logging tools, survey tools, telemetry tools etc.

As depicted in FIG. 1, the drilling assembly is comprised of a rotary drilling motor (30). The drilling motor (30) includes a drill bit (32) which is positioned at a lower end (34) of the lower assembly (28).

Figure 2:
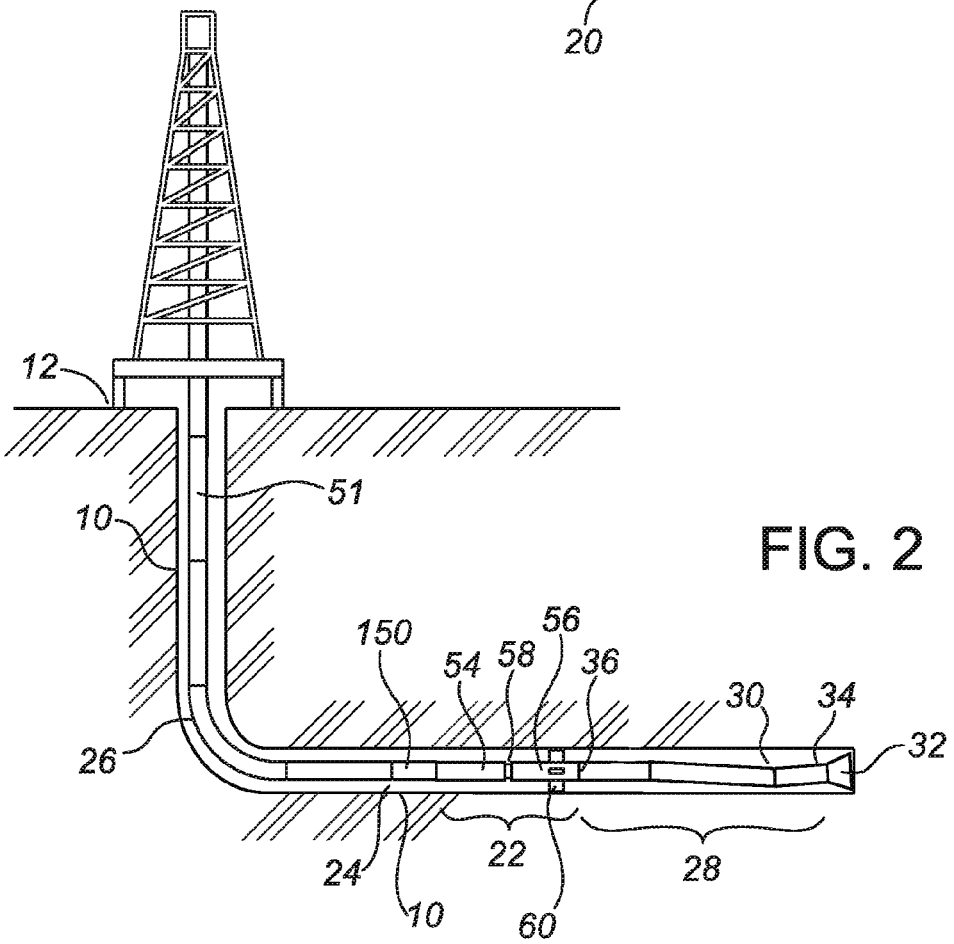
FIG. 2 is a schematic drawing of a second embodiment of the apparatus of the invention connected with a drilling string in a borehole.

The drilling string (26) may be comprised of a plurality of relatively short joints of pipe which are connected together, may be comprised of a single continuous length of pipe, or may be comprised of relatively long joints or lengths of pipe which are connected together. As depicted in FIG. 1, the drilling string (26) is comprised of a continuous length of pipe known as a coiled tubing (50). As depicted in FIG. 2, the drilling string (26) is comprised of relatively short joints of pipe (51) which are connected together.

Referring to FIG. 1, the coiled tubing (50) is stored on a spool (52) which is located at the surface location (12). If the length of a single spool (52) of coiled tubing (50) is not sufficient to complete the drilling operation, lengths of coiled tubing (50) may be connected together to form the drilling string (26).

In the embodiment depicted in FIG. 1, drilling is typically performed as sliding drilling wherein the drill bit (32) is rotated by the drilling motor (30) during drilling and the coiled tubing (50) is not rotated during drilling.

As depicted in FIG. 1, the upper assembly (22) is configured so that no portion of the upper assembly (22) is rotatable relative to the drilling string (26).

Referring to FIG. 2, in an alternate embodiment, the upper assembly (22) may be comprised of an upper section (54), a lower section (56) adjacent to the orientable rotatable connection (36), and a swivel connection (58) between the upper section (54) and the lower section (56) so that the upper section (54) is rotatable relative to the lower section (56). In the alternate embodiment depicted in FIG. 2, the lower section (56) may be comprised of a rotation restraining device (60) for restraining the lower section (56) of the lower assembly (28) from rotating relative to the borehole (10) during drilling.

The alternate embodiment depicted in FIG. 2 allows for the drilling string (26) to be rotated from the surface location (12) during drilling without rotating either the lower section (56) of the upper assembly (22) or the lower assembly (28), thus providing some of the known benefits of rotary drilling in the use of the invention.

Figure 3:
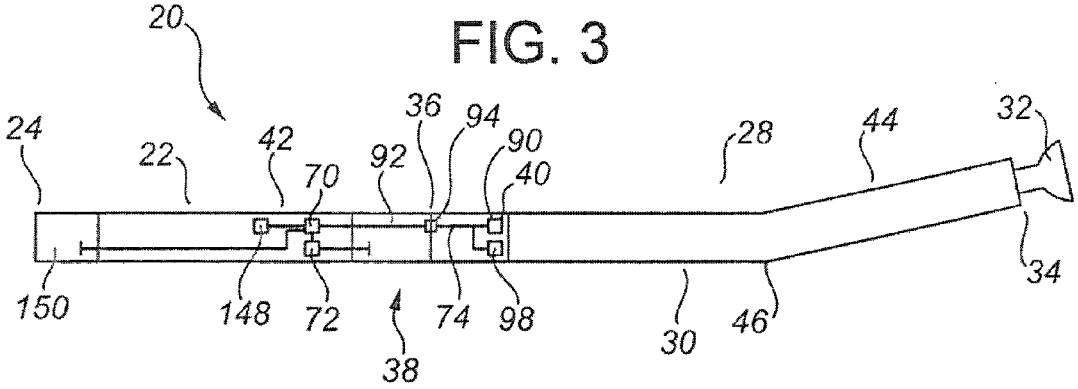
FIG. 3 is a schematic drawing of components of a one embodiment of the apparatus of the invention.
Figure 4:
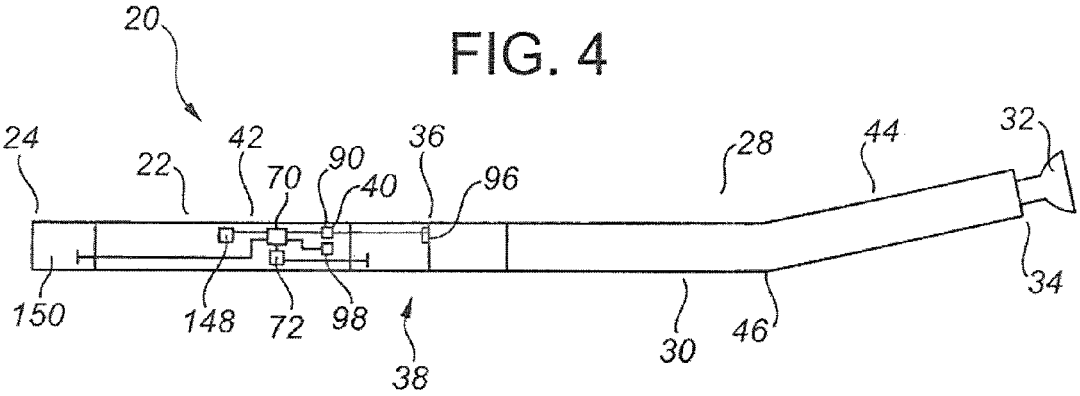
FIG. 4 is a schematic drawing of components of a second embodiment of the apparatus of the invention.

FIG. 3 and FIG. 4 provide more detailed schematic views of embodiments of the apparatus (20) of the invention in which components of the apparatus (20) are more fully depicted.

Referring to both FIG. 3 and FIG. 4, an orientable rotatable connection (36) is provided between the upper assembly (22) and the lower assembly (28).

A reactive torque control device (38) as a control device is associated with the orientable rotatable connection (36). The reactive torque control device (38) is actuatable to selectively allow rotation of the lower assembly (28) relative to the upper assembly (22) or prevent rotation of the lower assembly (28) relative to the upper assembly (22).

An orientation sensing device (40) provides a sensed actual orientation of the lower assembly (28).

A feedback control system (42) is associated with the reactive torque control device (38) and with the orientation sensing device (40). The feedback control system (42) is capable of actuating the reactive torque control device (38) in response to the sensed actual orientation of the lower assembly (28) in order to achieve a target orientation of the lower assembly (28).

In some embodiments, the lower assembly (28) provides a toolface orientation (44) to facilitate directional drilling. A desired toolface orientation (44) of the lower assembly (28) may be provided by the target orientation of the lower assembly (28). A desired toolface orientation (44) of the lower assembly (28) may be identical to the target orientation of the lower assembly (28) or may be referenced to the target orientation of the lower assembly (28).

The toolface orientation (44) may be provided in any manner and/or by any apparatus which enables the lower assembly (28) to provide the toolface orientation (44). For example, the toolface orientation (44) may be provided by a steering tool, where the term "steering tool" includes any apparatus which facilitates directional drilling by providing the toolface orientation (44).

In some embodiments, the toolface orientation (44) may be provided by a bend (46) associated with the lower assembly (28). The bend (46) may be provided by a bent sub, by a bent motor housing, or may be provided in any other suitable manner.

The feedback control system (42) may be comprised of any structure, device or apparatus or combination of structures, devices and apparatus which is capable of receiving input from the orientation sensing device (40) relating to the sensed actual orientation of the lower assembly (28) and actuating the reactive torque control device (38) in response to the input in order to achieve the target orientation of the lower assembly (28).

For example, referring to FIG. 3 and FIG. 4, in some embodiments the feedback control system (42) is comprised of a feedback processor (70) for processing the sensed actual orientation of the lower assembly (28) in order to generate a feedback actuation instruction for actuating the reactive torque control device (38) in order to achieve the target orientation of the lower assembly (28). The feedback control system (42) may also be comprised of a reactive torque control device controller (72) for receiving the feedback actuation instruction and for actuating the reactive torque control device (38) in order to implement the feedback actuation instruction. The feedback control system (42) may also be comprised of a feedback communication link (74) between the orientation sensing device (40) and the feedback processor (70), for transmitting the sensed actual orientation of the lower assembly (28) from the orientation sensing device (40) to the feedback processor (70).

The feedback processor (70) and the reactive torque control device controller (72) may be comprised of separate components or may be combined in a single apparatus or device.

The components of the feedback control system (42) may be associated with either the upper assembly (22) or the lower assembly (28). As depicted in FIG. 3 and FIG. 4, the components of the feedback control system (42) are associated with the upper assembly (22) so that the feedback control system (42) is a component of the upper assembly (22).

The orientation sensing device (40) may be comprised of any structure, device or apparatus which is capable of sensing the actual orientation of the lower assembly (28). The orientation sensing device (40) may be comprised of an orientation sensor (90). The orientation sensor (90) may be associated with either the upper assembly (22) or the lower assembly (28).

As previously described, the orientable rotatable connection (36) connects the upper assembly (22) and the lower assembly (28), with the result that the upper assembly (22) and the lower assembly (28) may rotate relative to each other. Consequently, there are advantages and disadvantages inherent in associating the orientation sensor (90) with either the upper assembly (22) or the lower assembly (28).

As one example, associating the orientation sensor (90) with the lower assembly (28) facilitates a direct determination of the sensed actual orientation of the lower assembly (28), but requires either that the feedback processor (70) be associated with the lower assembly (28) or that the feedback communication link (74) effect communication across the orientable rotatable connection (36). As a second example, associating the orientation sensor (90) with the upper assembly (22) enables the feedback processor (70) to be associated with the upper assembly (22) without requiring the feedback communication link (74) to effect communication across the orientable rotatable connection (36), but results in a sensed actual orientation of the upper assembly (22) which must somehow be referenced to the actual orientation of the lower assembly (28) in order to provide the sensed actual orientation of the lower assembly (28).

As a result, referring to FIG. 3, the orientation sensor (90) may be associated with the lower assembly (28) so that the orientation sensor (90) is a component of the lower assembly (28) and the feedback processor (70) may be associated with the upper assembly (22) so that the feedback processor (70) is a component of the upper assembly (22). In this configuration, the sensed actual orientation of the lower assembly (28) may be directly determined by the orientation sensor (90), the feedback communication link (74) may be comprised of a wireline (i.e., electrical cable) (92) between the orientation sensor (90) and the feedback processor (70), and a rotatable signal coupler (94) may be provided between the orientation sensor (90) and the feedback processor (70) in order to effect communication across the orientable rotatable connection (36).

The rotatable signal coupler (94) may be comprised of a slip ring, an inductive coupling, or any other suitable coupler which is capable of communicating signals across the orientable rotatable connection (36). As depicted in FIG. 3, the rotatable signal coupler (94) is a slip ring.

Referring to FIG. 4, the orientation sensor (90) may alternatively be associated with the upper assembly (22) so that the orientation sensor (90) is a component of the upper assembly (22) and the feedback processor (70) may be associated with the upper assembly (22) so that the feedback processor is a component of the upper assembly (22). In this configuration, the rotatable signal coupler (94) is not necessary, but the orientation sensor (90) provides a sensed actual orientation of the upper assembly (22). As a result, the orientation sensing device (40) may be comprised of a referencing device (96) for providing a reference orientation between the upper assembly (22) and the lower assembly (28) so that the sensed actual orientation of the lower assembly (28) can be obtained from the sensed actual orientation of the upper assembly (22).

Referring to FIG. 3 and FIG. 4, the apparatus (20) may be comprised of one or more sensing devices for sensing parameters other than the actual orientation of the lower assembly (28). Such parameters may relate to the apparatus (20), to the borehole (10) and/or surrounding formations, and/or to drilling performance.

Sensing devices for sensing parameters other than the actual orientation of the lower assembly (28) may be comprised of the orientation sensing device (40) so that the orientation sensing device (40) is capable of sensing parameters other than the actual orientation of the lower assembly (28). Alternatively, such sensing devices may be comprised of one or more parameter sensing devices (98) which are in addition to and/or separate from the orientation sensing device (40).

In some embodiments, such parameters other than the actual orientation of the lower assembly (28) may include an amount of rotation of the upper assembly (22) relative to the lower assembly (28) and/or an amount of rotation of the upper assembly (22) relative to the lower assembly (28) as a function of time (i.e., a measure of relative rotational velocity between the upper assembly (22) and the lower assembly (28)). In some embodiments, parameters relating to the rotation of the upper assembly (22) relative to the lower assembly (28) may be sensed by the orientation sensing device (40). In some embodiments, parameters relating to the rotation of the upper assembly (22) relative to the lower assembly (28) may be sensed by one or more parameter sensing devices (98) which are in addition to and/or separate from the orientation sensing device (40).

The parameter sensing devices (98) may be comprised of any suitable structures, devices or apparatus for sensing the desired parameters. The parameter sensing devices (98) may be associated with the feedback communication link (74) or may otherwise be capable of communicating with the feedback control system (42) so that data from the parameter sensing devices (98) may be used to provide feedback to the apparatus (20), including but not limited to feedback pertaining to maintaining or varying the desired toolface orientation (44) and/or feedback pertaining to the manner of actuation of the reactive torque control device (38).

The reactive torque control device (38) may be associated with either or both of the upper assembly (22) and the lower assembly (28). In some embodiments, the reactive torque control device (38) is associated with the upper assembly (22) so that the reactive torque control device is a component of the upper assembly (22).

The reactive torque control device (38) may be comprised of any structure, device or apparatus or combination of structures, devices or apparatus which is capable of being actuated to selectively allow rotation of the lower assembly (28) relative to the upper assembly (28) or prevent rotation of the lower assembly (28) relative to the upper assembly (22). As non-limiting examples, the reactive torque control device (38) may be comprised of a device such as those described in U.S. Pat. No. 5,485,889 (Gray), U.S. Pat. No. 6,059,050 (Gray) or U.S. Pat. App. Pub. No. US 2003/0056963 A1 (Wenzel).

Figure 5:
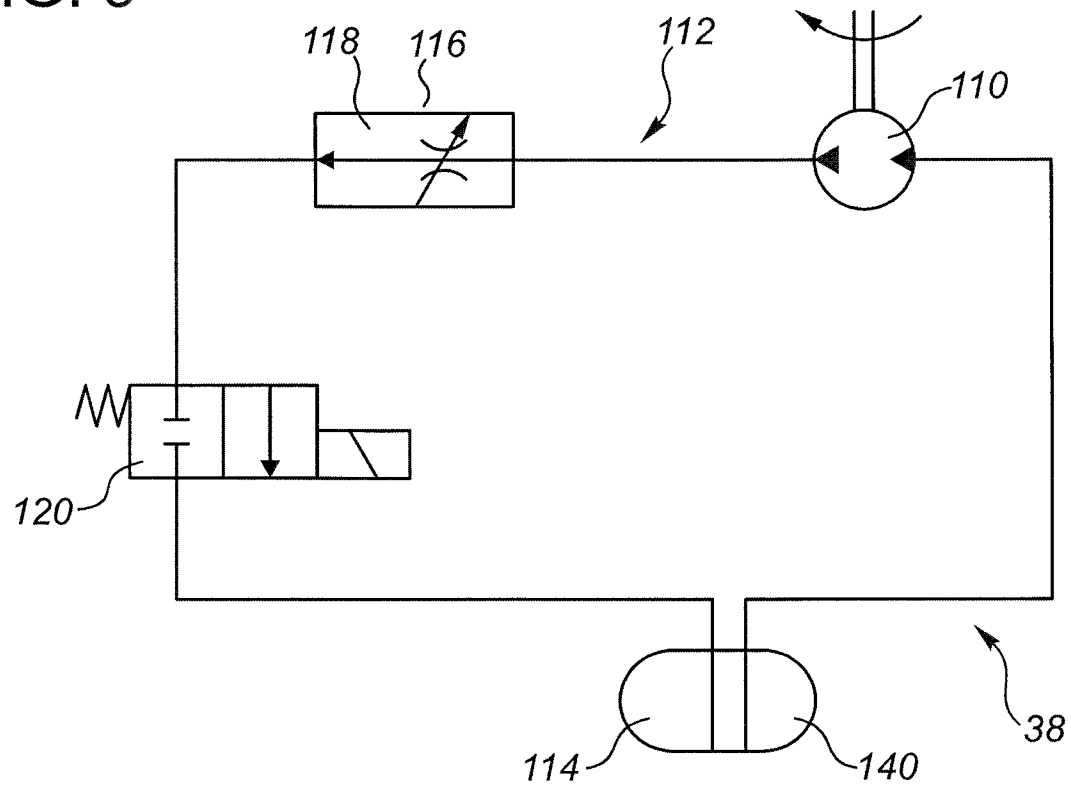
FIG. 5 is a hydraulic circuit diagram relating to a hydraulic circuit for use in one embodiment of a reactive torque control device according to the invention.

FIG. 5 provides a hydraulic circuit diagram for a first embodiment of the reactive torque control device (38).

Referring to FIG. 5, the reactive torque control device (38) may be comprised of a pump (110) and a loop (112) containing a pumping fluid (114), wherein the pump (110) pumps the pumping fluid (114) around the loop (112). As depicted in FIG. 5, the pump (110) is driven by relative rotation between the lower assembly (28) and the upper assembly (22). In other embodiments, the pump (110) may be driven by a power source other than the relative rotation between the lower assembly (28) and the upper assembly (22).

Referring to FIG. 5, the loop (112) is comprised of a pumping resistance (116). The pumping resistance (116) loads the pump (110) and thereby impedes the relative rotation between the lower assembly (28) and the upper assembly (22). The pumping resistance (116) may be adjustable. The pumping resistance (116) may be comprised of one or more flow restrictors (118) positioned in the loop (112).

The one or more flow restrictors (118) may be adjustable in order to adjust the pumping resistance (116). The one or more flow restrictors (118) may be adjustable by the reactive torque control device controller (72), or may be manually adjustable.

Referring to FIG. 5, the loop (112) may be selectively blocked in order to prevent the pumping fluid (114) from being pumped around the loop (112) by the pump (110). The reactive torque control device (38) may therefore be further comprised of one or more valves (120) positioned in the loop (112). The one or more valves (120) may be actuatable between an open position and a closed position in which the loop (112) is blocked in order to prevent the pumping fluid (114) from being pumped around the loop (112) by the pump (110).

The one or more valves (120) may be actuatable by the reactive torque control device controller (72). The one or more valves (120) may be solenoid type valves or any other suitable type of valve.

The pump (110) may be comprised of any type of pump which is suitable for pumping the pumping fluid around the loop (112). In embodiments where the pump (110) is driven by relative rotation between the lower assembly (28) and the upper assembly (22), the pump (110) may be a swash plate type pump. A low pressure reservoir (140) is included in the loop (112) to provide a source of the pumping fluid (114) for the pump (110).

Figure 6:
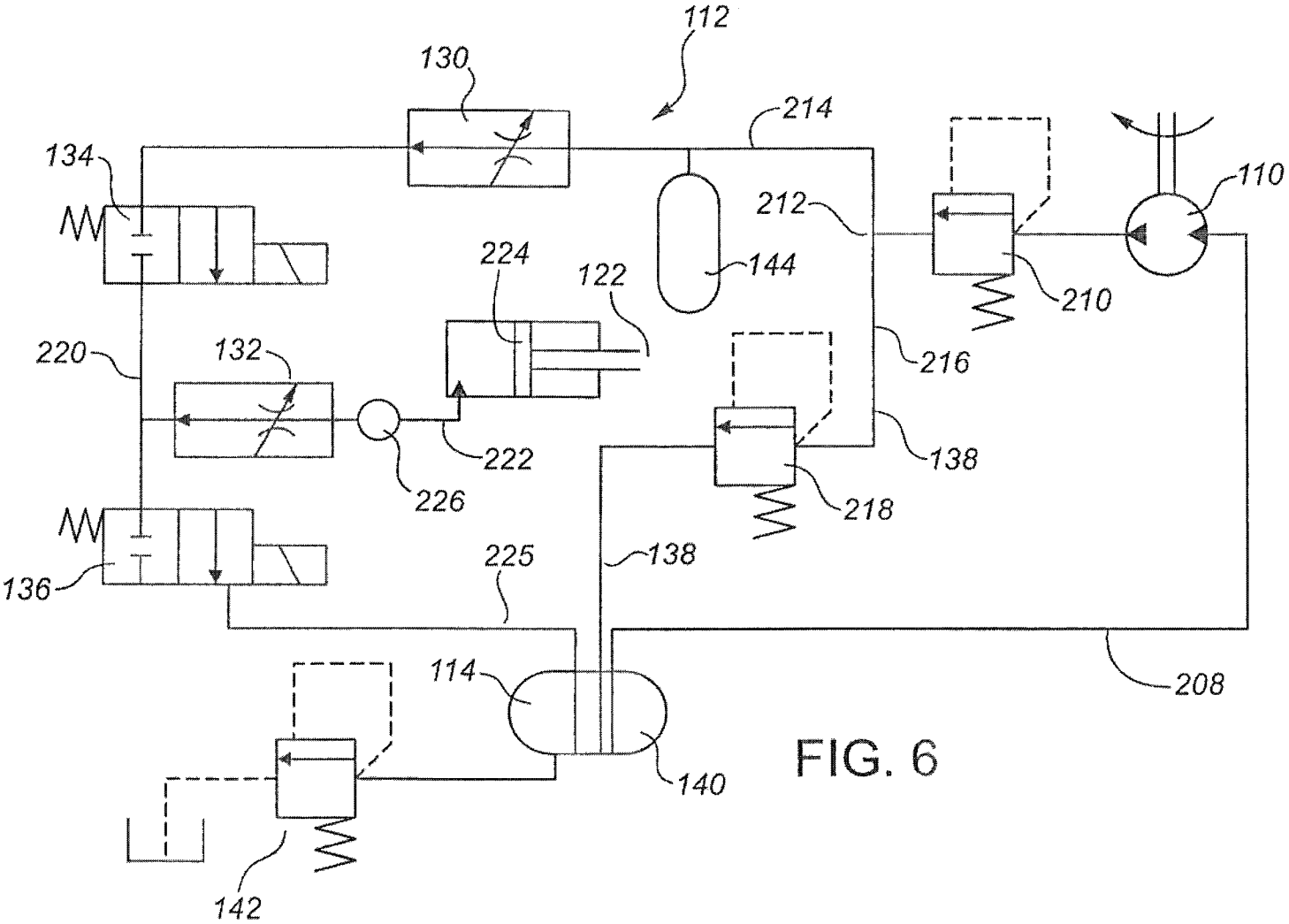
FIG. 6 is a hydraulic circuit diagram relating to a hydraulic circuit for use in a second embodiment of a reactive torque control device according to the invention.

FIG. 6 provides an hydraulic circuit diagram for a second embodiment of the reactive torque control device (38).

Referring to FIG. 6, the reactive torque control device (38) may be further comprised of a brake (122) which is associated with the loop (112). The brake (122) may be comprised of any structure, device or apparatus which is capable of providing a braking force between the upper assembly (22) and the lower assembly (28) in order to impede or prevent relative rotation between the lower assembly (28) and the upper assembly (22). As non-limiting examples, the braking force may be a frictional force, a magnetic force, an electromagnetic force, or a viscous fluid force, and the brake (122) may be comprised of any suitable braking mechanism and/or a clutch mechanism which may be adapted to be associated with the loop (112).

Referring to FIG. 6 and FIG. 7E, the brake (122) may be comprised of a first brake part (124) associated with the upper assembly (22) and a second brake part (126) associated with the lower assembly (28). The brake (122) may be actuated by a fluid pressure in the loop (112). The brake parts (124,126) may be urged into engagement with each other as a result of the fluid pressure in the loop (112), thereby providing an engagement force between the brake parts (124,126) which impedes the relative rotation between the lower assembly (28) and the upper assembly (22). The engagement force between the brake parts (124,126) may increase as the fluid pressure in the loop (112) increases.

Referring to FIG. 6, the pumping resistance (116) in the loop (112) may be comprised of a first flow restrictor (130) positioned in the loop (112) on an upstream side of the brake (122) and a second flow restrictor (132) positioned in the loop (112) on a downstream side of the brake (122).

Referring to FIG. 6, the reactive torque control device (38) may be comprised of a first valve (134) positioned in the loop (112) on the upstream side of the brake (122) and a second valve (136) positioned in the loop (112) on the downstream side of the brake (122). The valves (134,136) may each be actuated between an open position and a closed position in which the loop (112) is blocked between the first valve (134) and the second valve (136) in order to maintain the engagement force between the brake parts (124,126). The valves (134,136) may be actuatable by the reactive torque control device controller (72).

Referring to FIG. 6, the loop (112) may be comprised of a pressure relief bypass line (138) positioned in the loop (112), for bypassing the first valve (134) and the second valve (136) when the fluid pressure in the loop (112) exceeds a bypass pressure as determined by the pressure relief bypass line (138). As depicted in FIG. 6, the pressure relief bypass line (138) leads to the low pressure reservoir (140) which provides the pumping fluid (114) to the pump (110).

Referring to FIG. 6, the loop (112) may be further comprised of a dump valve (142) for releasing an amount of the pumping fluid (114) from the loop (112) when the fluid pressure in the loop (112) exceeds a dump pressure as determined by the dump valve (142).

Referring to FIG. 6, the reactive torque control device (38) may be further comprised of an accumulator (144) in communication with the loop (112), for supplying additional pumping fluid (114) to the loop (112) when the fluid pressure in the loop (112) is below an accumulator threshold pressure as determined by the accumulator (144).

The reactive torque control device (38) may be actuatable between a first position which provides a minimum resistance to relative rotation between the lower assembly (28) and the upper assembly (22), thereby allowing relative rotation between the lower assembly (28) and the upper assembly (22), and a second position which provides a maximum resistance to relative rotation between the lower assembly (28) and the upper assembly (22), thereby preventing relative rotation between the lower assembly (28) and the upper assembly (22).

In some embodiments, the reactive torque control device (38) may be actuatable to one or more intermediate positions between the first position and the second position, wherein the intermediate positions provide an intermediate resistance to rotation of the lower assembly (28) relative to the upper assembly (22). The intermediate positions may permit the lower assembly (28) to rotate relative to the upper assembly (22) at a rate which is slower than that permitted by the first position.

Depending upon the embodiment of the invention, the reactive torque control device (38) may be actuated amongst the first position, the second position and the intermediate positions by adjusting the pumping resistance (116) in the loop (112) and/or by actuating the one or more valves (120, 134,136).

Referring to FIG. 3 and FIG. 4, the feedback control system (42) may be further comprised of a memory (148). The memory (148) may be used to store any desired data, including data relating to the apparatus (20) and/or its operation, the borehole (10) and/or surrounding formations, and/or drilling performance.

For example, the memory (148) may be used to store a target orientation of the lower assembly (28) or a sequence of target orientations, a detailed borehole drilling plan for the apparatus (20), data collected by sensing devices (40,98) during the operation of the apparatus (20), or instructions in downlink communications provided from the surface location (12) during operation of the apparatus (20). The data and instructions may be stored in the memory (148) for later retrieval when the apparatus (20) is returned to the surface location (12) or for later communication to the surface location (12), and/or the data and instructions may be used by the feedback control system (42) to control the actuation of the reactive torque control device (38). For example, the data and instructions may be used to vary a target orientation or a sequence of target orientations in order to provide one or more updated target orientations.

The apparatus (20) may be operated in several different modes.

As one example, the apparatus (20) may be operated in a fully automated closed-loop mode in which the feedback control system (42) utilizes data contained in the memory (148), such as a detailed borehole drilling plan including a target orientation of the lower assembly (28) or a sequence of target orientations, data received from the orientation sensing device (40) and/or data received from parameter sensing devices (98) in order to control the operation of the apparatus (20) without input or intervention from the surface location (12). For example, data from the sensing devices (40,98) may be used to vary a target orientation or a sequence of target orientations in order to provide one or more updated target orientations.

As a second example, the apparatus (20) may be operated in a fully manual mode in which the reactive torque control device (38) is actuated by commands from the surface location (12), and in which the feedback control system (42) is effectively overridden by the commands. In this mode, the commands from the surface location (12) may follow the interpretation of data contained in uplink communications received at the surface location (12).

As a third example, the apparatus (20) may be operated in a variety of semi-automated closed-loop modes in which the feedback control system (42) achieves and maintains a target orientation of the lower assembly (28) or a sequence of target orientations in a similar manner as the fully automated closed-loop mode, but in which downlink communications can be provided to the feedback control system (42) and stored in the memory (148) in the form of downlink instructions varying a target orientation or a sequence of target orientations in order to provide one or more updated target orientations or an updated drilling plan, and/or in which the feedback control system (42) can be overridden from the surface location (12), and/or in which uplink communications can be provided to the surface location (12).

If the apparatus (20) is operated in the fully automated closed-loop mode, instructions in the form of target orientations and/or a detailed borehole drilling plan may be stored in the memory (148) at the surface location (12) before the apparatus (20) is deployed in the borehole (10), and data from the sensing devices (40,98) may also be stored in the memory (148) during the operation of the apparatus (20). As a result, in the fully automated closed-loop mode, there may be no need for either uplink or downlink communications between the apparatus (20) and the surface location (12).

If, however, the apparatus (20) is operated in the fully manual mode or in a semi-automated closed-loop mode, communication between the apparatus (20) and the surface location (12) is necessary.

Consequently, referring to FIG. 3 and FIG. 4, in some embodiments the apparatus (20) may be further comprised of a surface communication link (150) between the surface location (12) and the feedback control system (42), for communicating downlink communications and/or uplink communications between the surface location (12) and the feedback control system (42).

The downlink communications may be comprised of downlink instructions to the feedback control system (42) for actuating the reactive torque control device (38), such as for example one or more target orientations of the lower assembly (28).

The uplink communications may be comprised of data generated by the orientation sensing device (40) and/or data generated by parameter sensing devices (98).

The surface communication link (150) may be included as a dedicated component of the apparatus (20). Alternatively, the surface communication link (150) may be provided by a telemetry system of the type which is typically associated with the drilling string (26).

For example, the surface communication link (150) may be provided by a telemetry system such as a pressure pulse telemetry system, a fluid flowrate telemetry system comprising a turbine and a rotation sensor for sensing a rotational speed of the turbine, an electromagnetic (EM) telemetry system, an acoustic telemetry system, a wireline telemetry system, or any other type of telemetry system which is capable of communicating downlink communications and/or uplink communications between the surface location (12) and the feedback control system (42).

The telemetry system may be of the type typically described as a measurement-while-drilling (MWD) telemetry system, a logging-while-drilling (LWD) telemetry system or any other suitable type of telemetry system.

The telemetry system may be comprised of a telemetry system processor, and in some embodiments the feedback processor (70) may be comprised of the telemetry system processor so that the apparatus (20) does not include a dedicated feedback processor (70).

The telemetry system may be comprised of a telemetry system orientation sensor, and in some embodiments the orientation sensing device (40) may be comprised of the telemetry system orientation sensor so that the apparatus (20) does not include a dedicated orientation sensor (90).

In other embodiments, the telemetry system communicates with the feedback control system (42) and the orientation sensing device (40) which are included as dedicated components of the apparatus (20).

Figure 8:
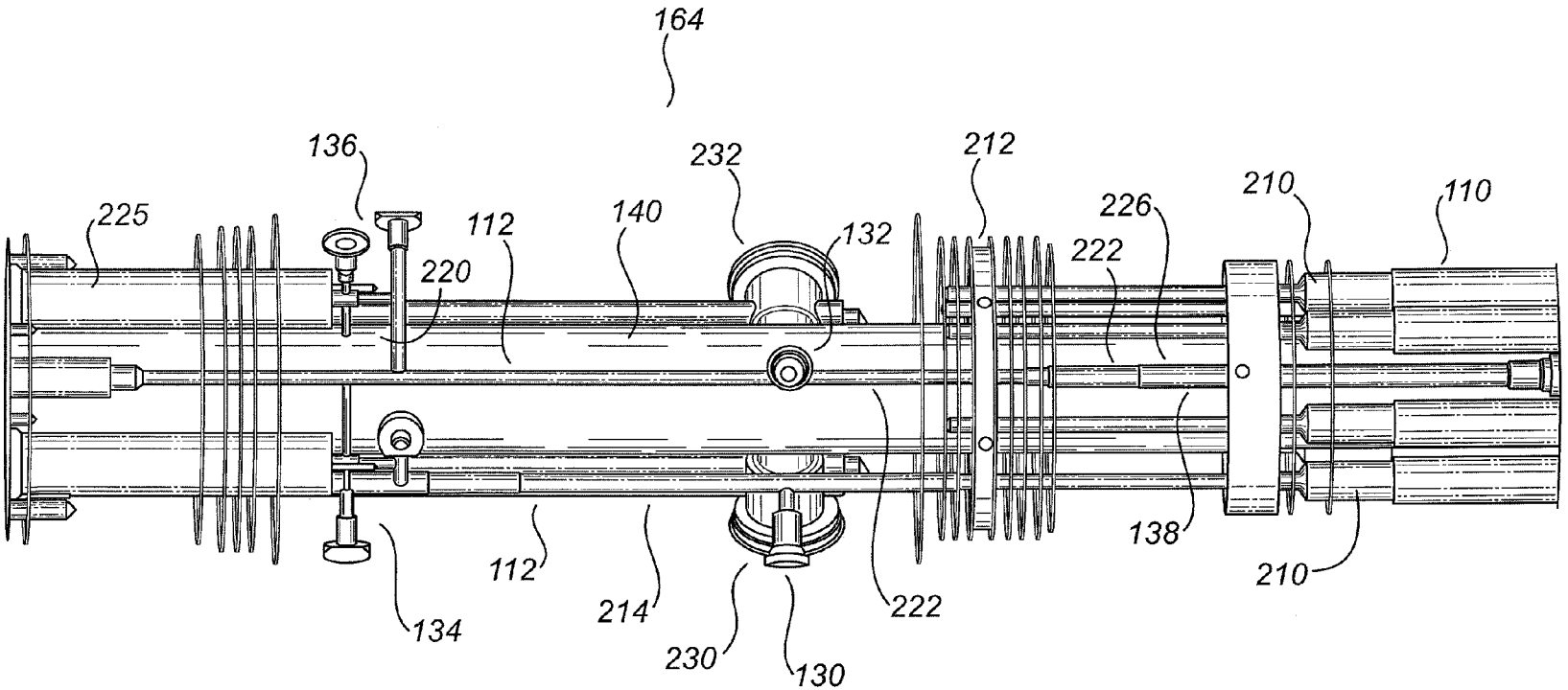
FIG. 8 is a first pictorial schematic drawing of features of the reactive torque control device in the embodiment of the apparatus of the invention depicted in FIG. 7.
Figure 9:
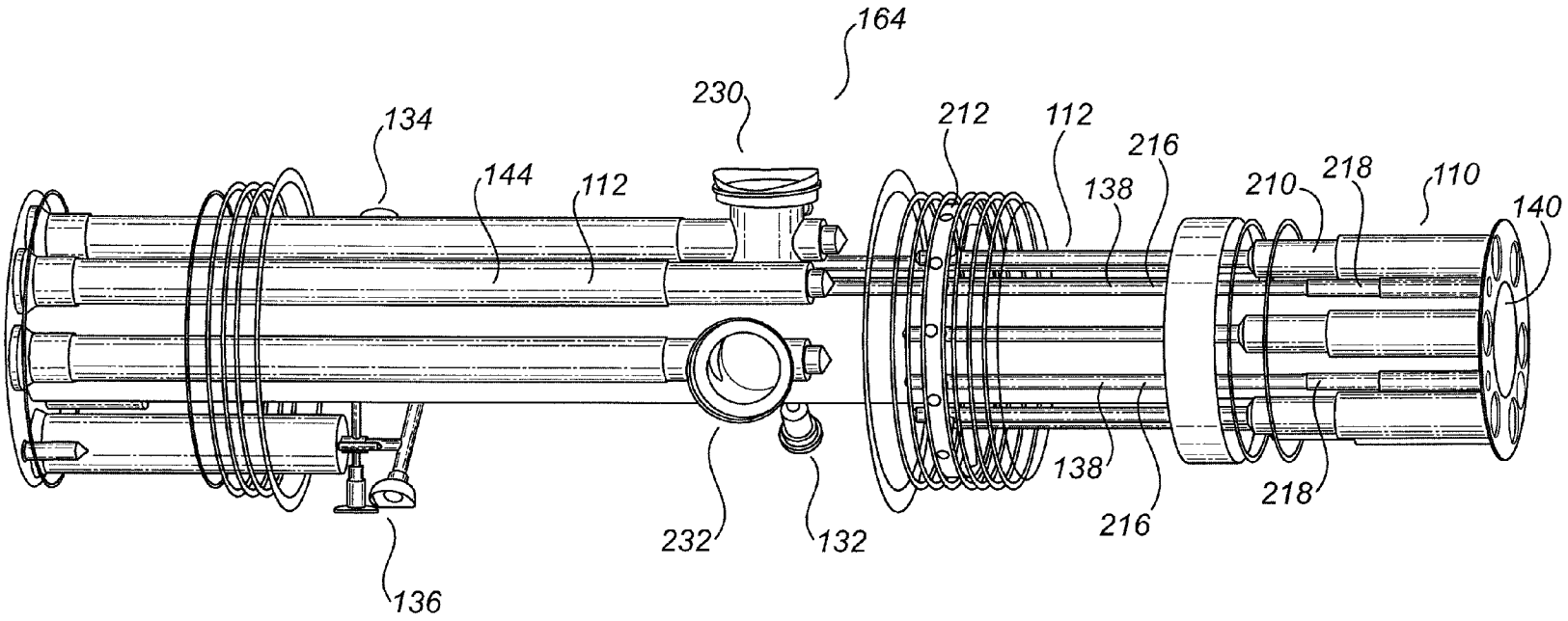
FIG. 9 is a second pictorial schematic drawing of features of the reactive torque control device in the embodiment of the apparatus of the invention depicted in FIG. 7 from a different viewing position than that of FIG. 8.

FIGS. 7A-7F are a longitudinal section assembly drawing of one example of an embodiment of the apparatus (20), which provides a detailed view of the components of the exemplary apparatus (20). FIG. 8 is a pictorial schematic drawing of components of the reactive torque control device (38), shown in isolation from the remainder of the apparatus (20). FIG. 9 is a pictorial schematic drawing of components of the reactive torque control device (38), shown in isolation from the remainder of the apparatus (20) and rotated approximately 180 degrees relative to FIG. 8.

The reference numbers used above will be used in the description that follows to the extent that the previously used reference numbers relate to equivalent structures in the particular embodiment.

Referring to FIGS. 7A-7F, the upper assembly (22) is comprised of several components connected end to end with threaded connections. Beginning at the upper end (24) of the upper assembly (22), the upper assembly (22) includes a sonde sub (160), an orientation sensing assembly (162), a pump assembly (164), and a brake assembly (166). The components (160,162,164,166) are each comprised of housings which define and/or contain parts and features of the apparatus (20). Each of the components (160,162,164,166) may be comprised of a single housing or may be comprised of a plurality of housing elements connected together.

Figure 7C:
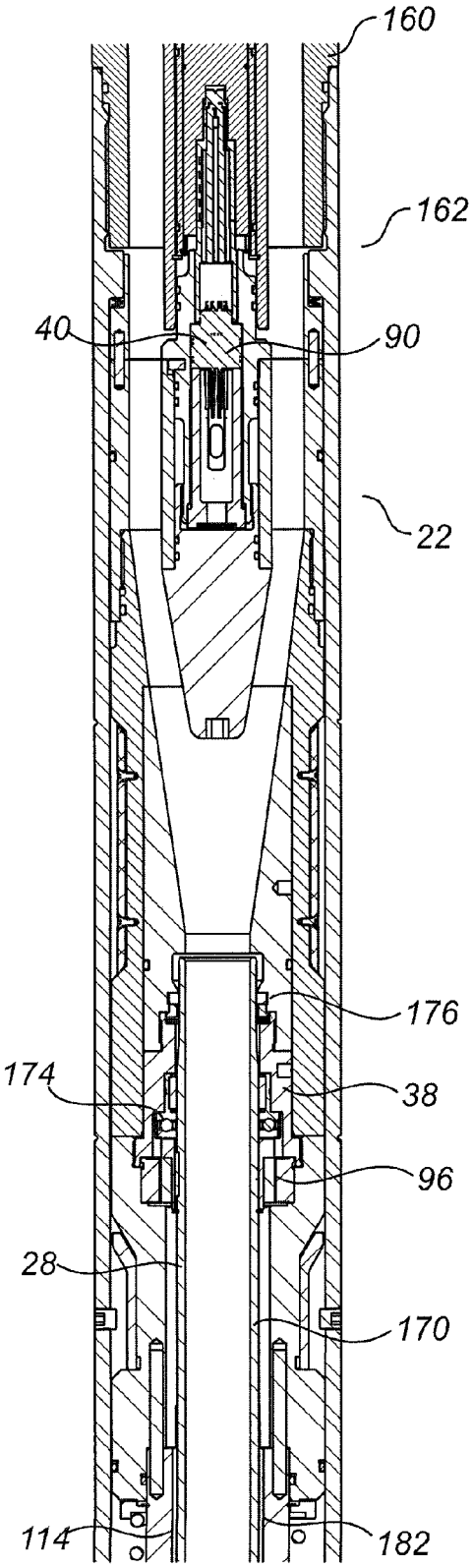

As depicted in FIGS. 7A-7C, the sonde sub (160) is comprised of a single sonde sub housing (161), the orientation sensing assembly (162) is comprised of a single orientation sensing assembly housing (163), the pump assembly (164) is comprised of a loop housing (165*a*) and a pump housing (165*b*), and the brake assembly (166) is comprised of a brake housing (167*a*), a bearing housing (167*b*) and a seal housing (167*c*).

The lower assembly (28) is comprised of an upper mandrel (170) and a lower mandrel (172) which are connected together with a threaded connection and which are rotatably mounted within the upper assembly (22) so that the upper end of the upper mandrel (170) is contained within the orientation sensing assembly (162) and so that the lower end of the lower mandrel (172) protrudes from the lower end of the brake assembly (166).

The lower assembly (28) is mounted within the upper assembly (22) with an upper bearing (174) and an upper rotary seal (176) which are contained within the orientation sensing assembly (162) and with a plurality of lower bearings (178) and a lower rotary seal (180) which are contained within the brake assembly (166). The bearings (174,178) are comprised of thrust bearings and radial bearings and facilitate the orientable rotatable connection (36) between the upper assembly (22) and the lower assembly (28). As depicted in FIGS. 7C and 7F, the bearings (174,178) include Kalsi™ thrust bearings manufactured by Kalsi Engineering, Inc. of Sugar Land, Tex.

The seals (176,180) provide a fluid chamber (182) within the apparatus (20) between the seals (176,180) which is isolated from fluids in the borehole (10). The fluid chamber (182) is contained with pumping fluid (114), which pumping fluid (114) also functions to lubricate components of the apparatus (20).

The lower assembly (28) further comprises a rotary drilling motor (30) which is threadably connected to the lower end of the lower mandrel (172) and a drill bit (32) which is threadably connected to the lower end of the drilling motor (30). Neither the drilling motor (30) nor the drill bit (32) are depicted in FIGS. 7A-7F, but are depicted in FIGS. 1-4.

If the apparatus (20) is to be operated in a fully automated closed-loop mode and no downlink or uplink communications between the apparatus (20) and the surface location (12) are required, the sonde sub (160) may be connected directly with a drilling string (26).

If however, it is necessary or desirable to provide for downlink and/or uplink communications, the sonde sub (160) may be connected with a surface communication link (150) such as a conventional measurement-while-drilling (MWD) module (which is not shown in FIG. 7, but is depicted in FIGS. 1-4) via an adapter (190) on the sonde sub (160), in which case the surface communication link (150) provides the upper end (24) of the upper assembly (24) and is connected with the drilling string (26).

The sonde sub (160) may be a conventional electronics sub as is known in the field of well logging. The functions of the sonde sub (160) include providing components of the feedback control system (42) and providing communication between the surface communication link (150) and other components of the apparatus (20) which are located below the sonde sub (160). Specifically, the sonde sub (160) contains the feedback control system (42), including the feedback processor (70) and the reactive torque control device controller (72), and provides a portion of the feedback communication link (74) between the orientation sensing device (40) and the feedback processor (70). The sonde sub (160) also contains the memory (148). The memory (148) is connected with the feedback processor (70).

The orientation sensing assembly (162) is connected to the lower end of the sonde sub (160). The primary function of the orientation sensing assembly (162) is to contain the orientation sensing device (40). The orientation sensing assembly (162) also provides a communication link between the feedback control system (42) and the reactive torque control device (38).

The orientation sensing device (40) is comprised of an orientation sensor (90) which is comprised of a conventional electronic orientation sensor package containing accelerometers and/or magnetometers, of the type known in the field of drilling tools. Since the orientation sensor (90) is located on the upper assembly (22), it senses the actual orientation of the upper assembly (22). Consequently, the orientation sensing device (40) is further comprised of a referencing device (96) for providing a referencing orientation between the upper assembly (22) and the lower assembly (28).

The referencing device (96) is comprised of a resolver. The resolver is comprised of an inner ring and an outer ring. The inner ring is mounted on the upper mandrel (170) and the outer ring is mounted on the orientation sensing assembly (162). The relative positions of the rings provide the reference orientation between the upper assembly (22) and the lower assembly (28).

The orientation sensing device (40) therefore senses the actual orientation of the upper assembly (22) and senses a reference orientation between the upper assembly (22) and the lower assembly (28) so that the actual orientation of the lower assembly (28) can be determined.

Figure 7D:
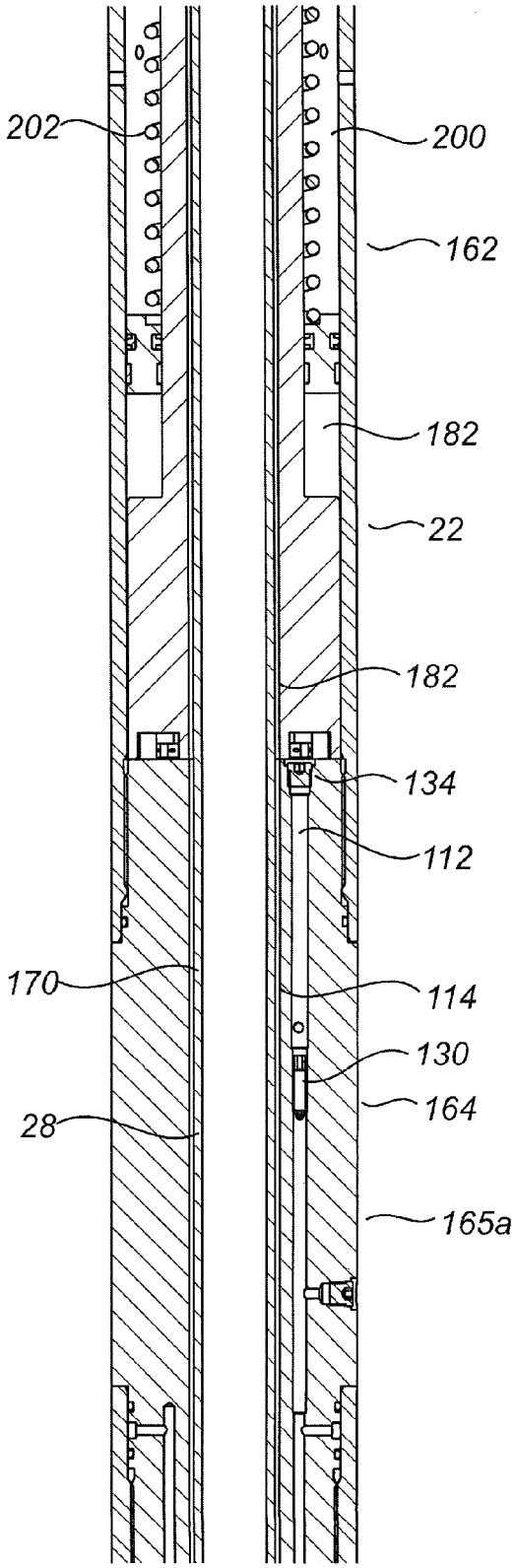

Referring to FIGS. 7D and 7E, the pump assembly (164) is connected to the lower end of the orientation sensing assembly (162). The primary function of the pump assembly (164) is to contain components of the reactive torque control device (38).

An upper pressure compensation assembly (200) is also provided between the orientation sensing assembly (162) and the pump assembly (164). The upper pressure balancing assembly (200) comprising a pressure balancing chamber and a pressure balancing piston contained within the pressure balancing chamber. A fluid chamber side of the pressure balancing chamber is in fluid communication with the fluid chamber (182) and a borehole side of the pressure balancing chamber is in fluid communication with the borehole (10) so that the pressure within the borehole (10) is communicated to the fluid chamber (182) by the pressure balancing piston, thereby reducing the pressure differential across the seals (176,180). A spring (202) is provided in the borehole side of the pressure balancing chamber to provide a positive pressure differential between the fluid chamber (182) and the borehole (10).

The reactive torque control device (38) for the embodiment depicted in FIGS. 7-9 is essentially identical to the reactive torque control device (38) depicted in FIG. 6 and discussed above. Referring to FIGS. 7-9, the reactive torque control device (38) therefore includes the pump (110), the loop (112), the brake (122), the first flow restrictor (130), the second flow restrictor (132), the first valve (134), the second valve (136), the pressure relief bypass line (138), the reservoir (140), the dump valve (142) and the accumulator (144).

In the embodiment depicted in FIGS. 7-9, the pump (110) is a swash plate pump comprising six cylinders spaced circumferentially around the pump sub (164) so that the pump (110) is driven by relative rotation between the lower assembly (28) and the upper assembly (22).

In the embodiment depicted in FIGS. 7-9, the loop (112) is primarily comprised of a collection of ports and channels contained within or formed by the pump sub (164).

In the embodiment depicted in FIGS. 7-9, the flow restrictors (130,132) are both Flosert™ adjustable flow restrictors manufactured by The Lee Company, USA of Westport, Conn. The Flosert™ adjustable flow restrictors provide a constant flow rate over a wide range of pressure conditions, and can be adjusted to provide different flow rates. As depicted in FIGS. 7-9, the flow restrictors (130,132) may be adjusted to provide the same flow rates, thereby providing the same flow rate of the pumping fluid (114) toward the brake (122) as away from the brake (122). In the embodiment contemplated in FIGS. 7-9, the flow restrictors (130,132) are manually adjustable to provide a desired flow rate and thus a desired pumping resistance (116) before the apparatus (20) is deployed in the borehole (10). The flow restrictors (130,132) could, however be configured to be adjustable by the reactive torque control device controller (72).

In the embodiment depicted in FIGS. 7-9, the valves (134, 136) are both solenoid type valves which are electrically actuatable by the reactive torque control device controller (72).

Referring back to FIG. 6 and to FIGS. 8-9, the loop (112) begins with the pump (110). The pumping fluid (114) is drawn from the reservoir (140) and pumped by the pump (110) via a reservoir supply line (208) as the lower assembly (28) rotates relative to the upper assembly (22). The pumping fluid (114) passes through check valves (210) to a 360° (i.e., circular) manifold (212). Two lines extend from the manifold (212).

A first manifold line (214) extends between the manifold (212) and the first valve (134). The first flow restrictor (130) is positioned within the first manifold line (214) in order to control the flow rate of the pumping fluid (114) and to assist in providing the pumping resistance (116).

A second manifold line (216) extends between the manifold (212) and a pressure relief bypass valve (218) so that the second manifold line (216) and the pressure relief bypass valve (218) together provide the pressure relief bypass line (138). In the embodiment depicted in FIGS. 7-9, two pressure relief bypass lines (138) are provided as redundant components.

If the first valve (134) is closed, the fluid pressure in the manifold (212) will increase as the pump (110) pumps the pumping fluid (114) until the fluid pressure exceeds the bypass pressure, at which point the pumping fluid (114) will pass through the pressure relief bypass valve (218) to the reservoir (140). The reservoir (140) is comprised of the annular space which is provided between the upper assembly (22) and the lower assembly (28) along the length of the apparatus (20) between the seals (176,180).

If the first valve (134) is open, the pumping fluid (114) passes from the first manifold line (214) to a brake actuation line (220) which extends between the first valve (134) and the second valve (136).

A brake pressure line (222) extends between the brake actuation line (220) and a brake piston (224) so that the fluid pressure in the brake pressure line (222) is equal to the fluid pressure in the brake actuation line (220).

Referring to FIG. 7E, the brake piston (224) and the brake (122) are contained in the brake assembly (166). The brake piston (224) abuts the first brake part (124) such that movement of the brake piston (224) in the brake pressure line (222) under the influence of fluid pressure in the brake actuation line (220) urges the first brake part (124) toward the second brake part (126), thereby providing an engagement force between the brake parts (124,126). The first brake part (124) is keyed to the upper assembly (22) so that it may reciprocate relative to the upper assembly (22) but may not rotate relative to the upper assembly (22). As the fluid pressure in the brake actuation line (220) increases, the engagement force between the brake parts (124,126) also increases.

The second flow restrictor (132) is positioned within the brake pressure line (222) between the brake (122) and the second valve (136) in order to control the flow rate of the pumping fluid (114) between the brake (122) and the reservoir (140) and in order to provide the pumping resistance (116).

If the second valve (136) is closed, the pumping fluid (214) will continue to pass through the pressure relief bypass valve (218) to the reservoir (140), with the result that the fluid pressure in the brake actuation line (220) will not exceed the bypass pressure.

If the second valve (136) is open, the pumping fluid (214) will pass from the brake actuation line (220) and the brake pressure line (222) back to the reservoir (140) via a reservoir return line (225). The second flow restrictor (132) limits the flow rate of the pumping fluid through the brake actuation line (220) and assists in providing the pumping resistance (116).

A pressure transducer (226) is positioned in the brake pressure line (222). The pressure transducer (226) senses the fluid pressure in the brake pressure line (222), which can be correlated to the engagement force between the brake parts (124,126). The pressure transducer (226) may also be connected with the feedback processor (70) so that the reactive torque control device (38) can be actuated in response to the fluid pressure in the brake pressure line (222).

In the embodiment depicted in FIGS. 7-9, the reactive torque control device (38) is further comprised of a first loop pressure compensation assembly (230) and a second loop pressure compensation assembly (232), each of which is similar in design to the upper pressure compensation assembly (200). The first loop pressure compensation assembly (230) communicates the pressure in the borehole (10) to the portion of the loop (112) which is between the pump (110) and the first valve (134). The second loop pressure compensation assembly (232) communicates the pressure in the borehole (10) to the portion of the loop (112) which is between the second valve (136) and the reservoir (140).

The lower bearing (178) is contained within the bearing housing (167*b*) of the brake assembly (166). The lower seal (180) is contained within the seal housing (167*c*) of the brake assembly (166). The lower end of the lower mandrel (172) of the lower assembly (28) extends below the lower end of the seal housing (167*c*) of the brake assembly (166).

The drilling motor (30) is directly or indirectly connected to the lower end of the lower mandrel (172) and the drill bit (32) is directly or indirectly connected to the lower end of the drilling motor (30) so that the lower assembly (28) is comprised of the drilling motor (30) and the drill bit (32). In order to facilitate directional drilling, the lower assembly (28) provides the toolface orientation (44), which in turn may be provided by a bend (46) in the lower mandrel (172), by a bend in the drilling motor (30), by a bent sub which is connected within the lower assembly (28), by a steering tool (48), or in any other suitable manner.

The reactive torque control device (38) may be selectively actuated by the reactive torque control device controller (72) either to allow rotation of the lower assembly (28) relative to the upper assembly (22) or to prevent rotation of the lower assembly (28) relative to the upper assembly (22). When the reactive torque control device (38) is actuated to allow relative rotation of the lower assembly (28) and the upper assembly (22), non-directional or "straight" drilling is facilitated. When the reactive torque control device (38) is actuated to prevent relative rotation of the lower assembly (28) and the upper assembly (22), directional drilling is facilitated by establishing and maintaining a desired toolface orientation (44) and thus a target orientation of the lower assembly (28).

The target orientation of the lower assembly (28) may be comprised of a single target orientation or the target orientation of the lower assembly (28) may be comprised of a sequence of target orientations as part of a borehole drilling plan. A single target orientation or a sequence of target orientations may be stored in the memory (148) before deployment of the apparatus (20) or may be communicated to the feedback control system (42) and stored in the memory (148) as a downlink instruction via the surface communication link (150).

A target orientation or a sequence of target orientations may vary during drilling of the borehole (10) as a result of downlink instructions via the surface communication link (150), or as a result of data received by the feedback control system (42) from the orientation sensing device (40) and/or from parameter sensing devices (98) associated with the apparatus (20). For example, data relating to the composition or condition of formations being intersected during drilling, or data relating to the performance or condition of the apparatus (20) may necessitate or render desirable a change in the desired toolface orientation (44) and thus the target orientation of the lower assembly (28).

The actuation of the reactive torque control device (38) may also be controlled and/or modified during use of the apparatus as a result of downlink instructions via the surface communication link (150), or as a result of data received by the feedback control system (42) from the orientation sensing device (40) and/or from parameter sensing devices (98) associated with the apparatus (20). For example, data from sensing devices (40,98) may suggest that the timing of the actuation of the reactive torque control device (38) should be modified, that the pumping resistance (116) should be modified, or that some other parameter relating to the actuation of the reactive torque control device (38) should be modified.

The apparatus (20) or other devices having certain features of the apparatus (20) may be used to perform methods of directional drilling.

As one example, embodiments of a method of directional drilling of a borehole (10) may use an apparatus (20) comprising an upper assembly (22) connected with a drilling string (26), a lower assembly (28) comprising a rotary drilling motor (30) such that the lower assembly (28) is subjected to reactive torque during drilling as a result of the operation of the drilling motor (30), an orientable rotatable connection (36) between the upper assembly (22) and the lower assembly (28), and a reactive torque control device (38) associated with the orientable rotatable connection (36), wherein the reactive torque control device (38) is actuatable to selectively allow rotation of the lower assembly (28) relative to the upper assembly (22) or prevent rotation of the lower assembly (28) relative to the upper assembly (22). The apparatus (20) may also include other features as described above with respect to the apparatus (20) of the invention.

In such embodiments, the method may comprise:

(a) actuating the reactive torque control device (38) to prevent rotation of the lower assembly (28) relative to the upper assembly (22);
(b) providing a sensed actual orientation of the lower assembly (28);
(c) comparing the sensed actual orientation of the lower assembly (28) with a target orientation of the lower assembly (28);
(d) actuating the reactive torque control device (38) to allow the lower assembly (28) to rotate relative to the upper assembly (22);
(e) operating the drilling motor (30) in order to provide the target orientation of the lower assembly (28); and
(f) actuating the reactive torque control device (38) to prevent rotation of the lower assembly (28) relative to the upper assembly (22).

All or portions of the above described method may be repeated while directional drilling is being performed in order to maintain the target orientation of the lower assembly (28) and/or in order to obtain and/or maintain updated target orientations of the lower assembly (28). The method may therefore be used to adjust for slippage or drift from a target orientation during drilling and/or to adapt to updated target orientations which may be provided or generated during drilling.

In the embodiment of the apparatus (20) as depicted in FIGS. 7-9, the reactive torque control device (38) may be actuated to allow rotation of the lower assembly (28) relative to the upper assembly (22) by providing a fluid pressure in the brake pressure line (222) which is less than a locking pressure which is required to provide an engagement force between the brake parts (124,126) which is less than that which is required to prevent relative rotation of the lower assembly (28) and the upper assembly (22).

Such a fluid pressure may be achieved by selectively actuating the valves (134,136). As one example, the first valve (134) may be actuated to the closed position while the second valve (136) is actuated to the open position. As a second example, both valves (134,136) may be actuated to the closed position while the fluid pressure in the brake pressure line (222) is less than the locking pressure. As a third example, both valves (134,136) may be actuated to the open position if the pumping resistance (116) in the loop (112) provides a fluid pressure in the brake pressure line (222) while the pumping fluid (114) is being pumped around the loop (112) which is less than the locking pressure.

In the embodiment of the apparatus (20) as depicted in FIGS. 7-9, the reactive torque control device (38) may be actuated to prevent rotation of the lower assembly (28) relative to the upper assembly (22) by providing a fluid pressure in the brake pressure line (222) which is greater than or equal to a locking pressure which is required to provide an engagement force between the brake parts (124,126) which is greater than that which is required to prevent relative rotation of the lower assembly (28) and the upper assembly (22).

Such a fluid pressure may be achieved by selectively actuating the valves (134,136). As one example, the first valve (134) may be actuated to the open position while the second valve (136) is actuated to the closed position, thereby causing the fluid pressure in the brake pressure line (222) to increase to the locking pressure (which locking pressure is less than or equal to the bypass pressure as determined by the pressure relief bypass line (138)). The first valve (134) may then be closed in order to "trap" the locking pressure in the brake pressure line (222).

The reactive torque control device (38) will remain actuated to prevent relative rotation of the lower assembly (28) relative to the upper assembly (22) until the fluid pressure in the brake pressure line (222) is reduced below the locking pressure. This may be achieved by actuating the second valve (136) to the open position in order to permit the pumping fluid (114) to move from the brake pressure line (222) back to the reservoir (140).

The apparatus (20) or other devices comprising a first assembly, a second assembly, an orientable rotatable connection, and a control device associated with the orientable rotatable connection may be used to perform various embodiments of a control device control method, in order to obtain and/or maintain a target orientation of the first assembly or the second assembly, or in order to obtain and/or maintain a target rotation rate of the second assembly relative to the first assembly.

A potential challenge faced by embodiments of the control device control method is in controlling the actuation of the control device so that an actual orientation within an acceptable variance of the target orientation or an actual rotation rate within an acceptable variance of the target rotation rate can be achieved and/or maintained efficiently, effectively and relatively quickly without excessive iteration.

This challenge is increased if a force exerted on the first assembly and/or the second assembly which tends to cause the first assembly and the second assembly to rotate relative to each other is not constant. For example, it has been found that the reactive torque and thus the force which is exerted on the lower assembly (28) of the apparatus (20) during use of the apparatus (20) for directional drilling may tend to fluctuate significantly during drilling.

Figure 10:
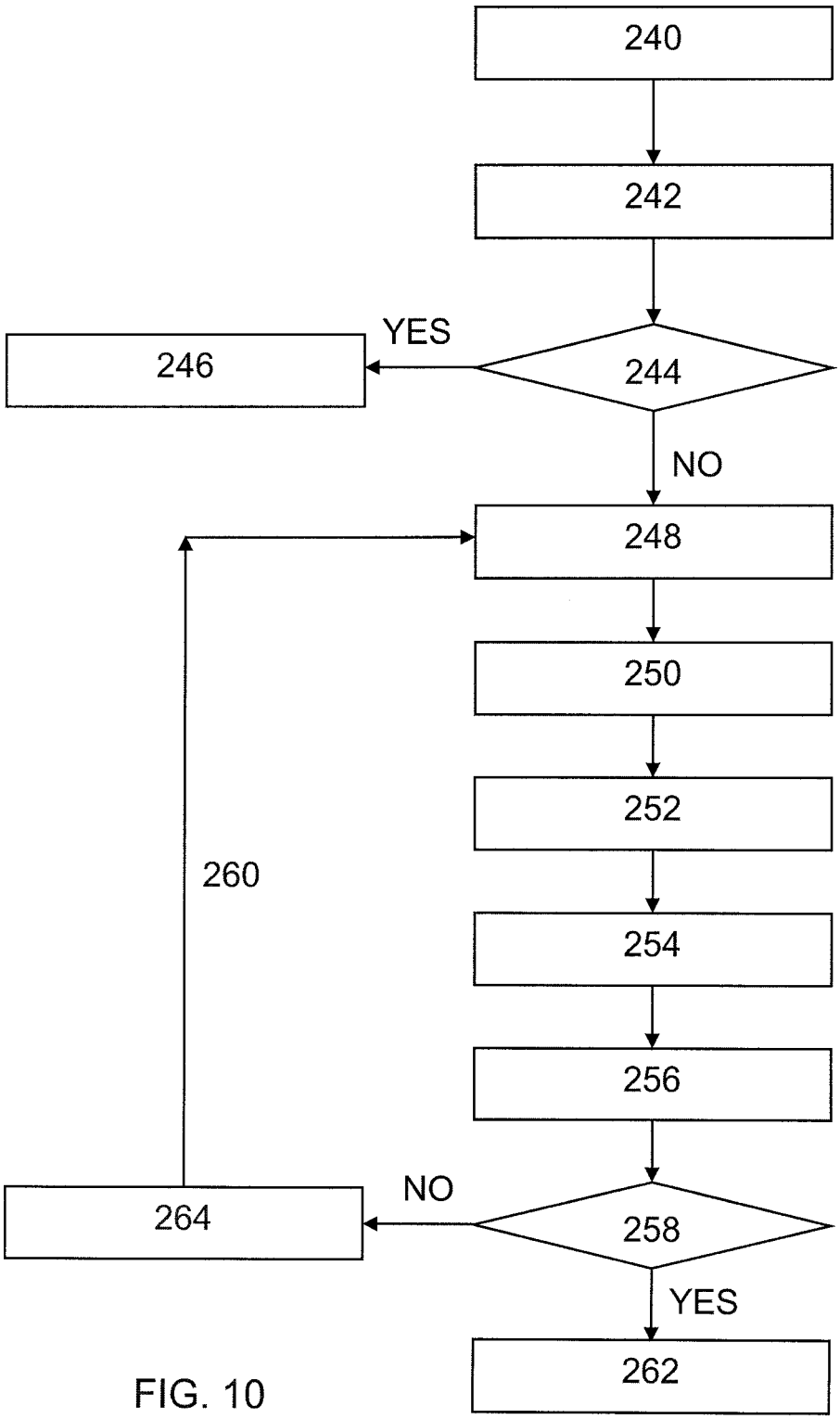
FIG. 10 is a flowchart of a first exemplary embodiment of a control device control method for controlling an apparatus of the type comprising a first assembly, a second assembly, an orientable rotatable connection between the first assembly and the second assembly, and a control device associated with the orientable rotatable connection.
Figure 11:
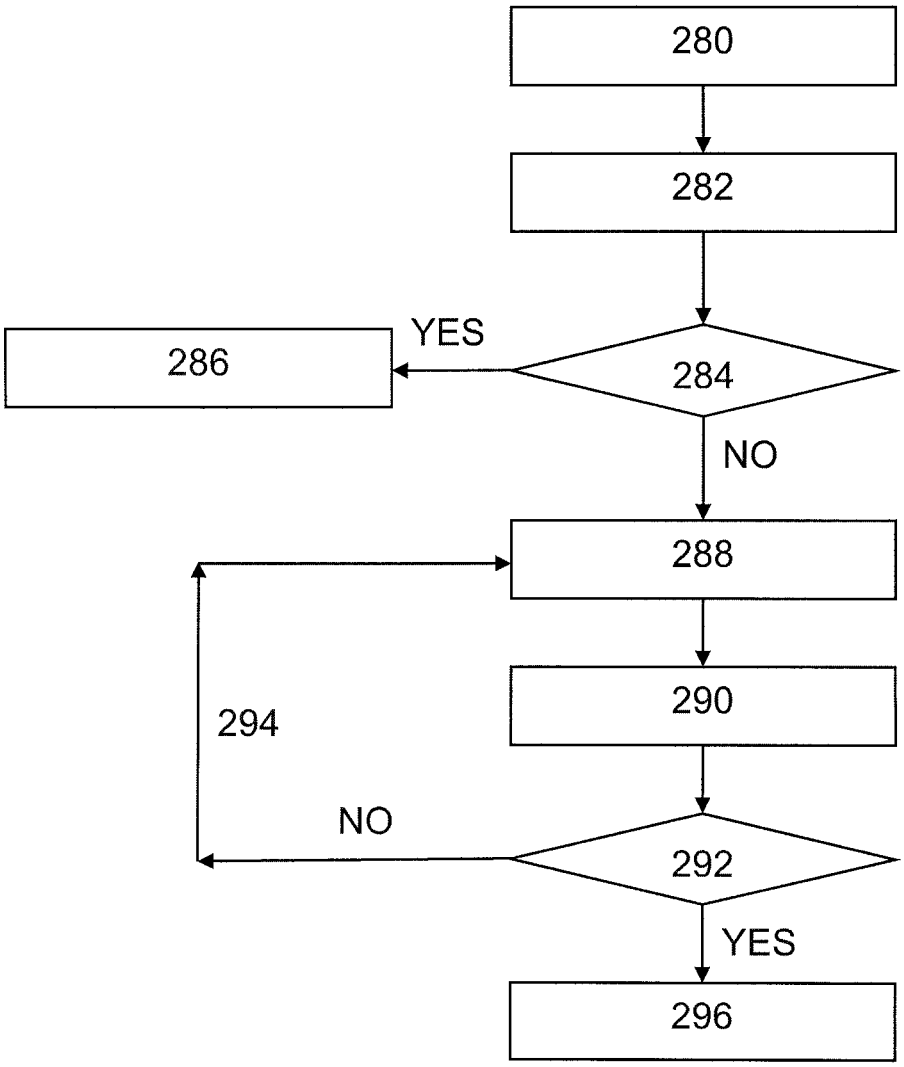
FIG. 11 is a flowchart of a second exemplary embodiment of a control device control method for controlling an apparatus of the type comprising a first assembly, a second assembly, an orientable rotatable connection between the first assembly and the second assembly, and a control device associated with the orientable rotatable connection.
Figure 13:
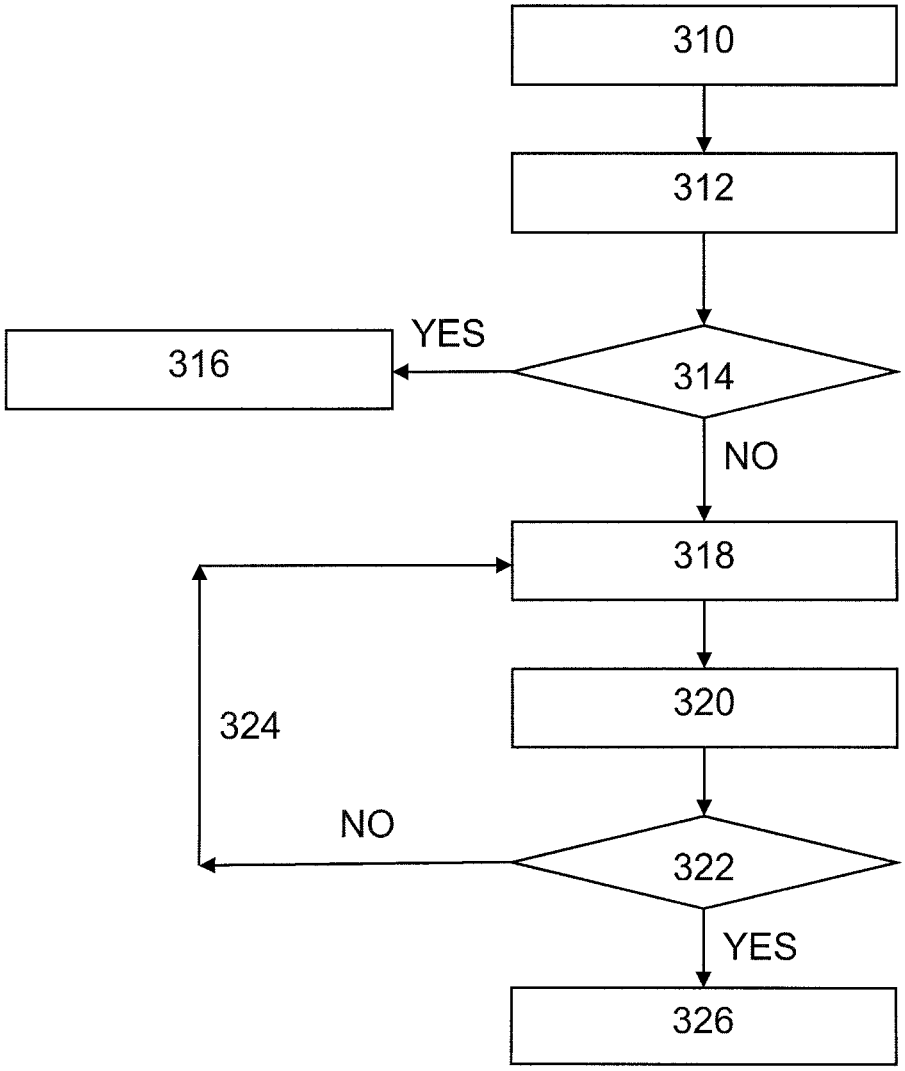
FIG. 13 is a flowchart of a third exemplary embodiment of a control device control method for controlling an apparatus of the type comprising a first assembly, a second assembly, an orientable rotatable connection between the first assembly and the second assembly, and a control device associated with the orientable rotatable connection.

Referring to FIG. 10, FIG. 11 and FIG. 13, flowcharts are provided of a first exemplary embodiment, a second exemplary embodiment and a third exemplary embodiment respectively of a control device control method for use with an apparatus of the type comprising a first assembly, a second assembly, an orientable rotatable connection between the first assembly and the second assembly, and a control device associated with the orientable rotatable connection, wherein the control device is actuatable to selectively allow rotation of the second assembly relative to the first assembly or prevent rotation of the second assembly relative to the first assembly. A suitable apparatus for use with the control device control method includes, but is not limited to, the apparatus (20) described above, comprising an upper assembly (22) as the first assembly, a lower assembly (28) as the second assembly, and a reactive torque control device (38) as the control device.

The first exemplary embodiment and the second exemplary embodiment of the control device control method depicted in FIG. 10 and FIG. 11 respectively are directed at controlling the actuation of the control device in order to obtain and/or maintain a target orientation of the second assembly. In some embodiments, the first exemplary embodiment and the second exemplary embodiment of the control device control method may be used to adjust for slippage or drift from a target orientation during drilling and/or to adapt to updated target orientations which may be provided or generated during drilling.

The embodiment of the control device control method depicted in FIG. 13 is directed at controlling the actuation of the control device in order to obtain and/or maintain a target rotation rate of the second assembly relative to the first assembly. In some embodiments, the third exemplary embodiment of the control device control method may be used to control the amount of relative rotation between the first assembly and the second assembly during drilling.

Referring to FIG. 10, the first exemplary embodiment of the control device control method comprises:

(240) providing a force tending to cause rotation of the first assembly and the second assembly relative to each other;

(242) determining an actual orientation of the second assembly with the control device actuated to prevent rotation of the second assembly relative to the first assembly;

(244) comparing the actual orientation of the second assembly with a target orientation of the second assembly in order to determine if the actual orientation of the second assembly is acceptable;

(246) if the actual orientation of the second assembly is acceptable, maintaining the control device actuated to prevent rotation of the second assembly relative to the first assembly;

(248) if the actual orientation of the second assembly is not acceptable, first actuating the control device to allow the second assembly to rotate relative to the first assembly;

(250) obtaining a rotational velocity indication of the second assembly relative to the first assembly;

(252) calculating, using the rotational velocity indication, a predicted actuation time for actuating the control device to prevent rotation of the second assembly relative to the first assembly in order to achieve the target orientation of the second assembly;

(254) second actuating the control device at the predicted actuation time to prevent rotation of the second assembly relative to the first assembly;

(256) determining an updated actual orientation of the second assembly;

(258) comparing the updated actual orientation of the second assembly with the target orientation of the second assembly in order to determine if the updated actual orientation of the second assembly is acceptable;

(260) if the updated actual orientation of the second assembly is not acceptable, repeating blocks (248) through (258), using the updated actual orientation of the second assembly as the actual orientation of the second assembly; and (262) if the updated actual orientation of the second assembly is acceptable, maintaining the control device actuated to prevent rotation of the second assembly relative to the first assembly.

Also referring to FIG. 10, the first exemplary embodiment of the control device control method may be further comprised of calculating an actuation time correction factor (264) if the updated actual orientation of the second assembly is not acceptable and blocks (248) through (258) are therefore to be repeated. The actuation time correction factor may be used in a subsequent calculation of the predicted actuation time in block (252). Iterations of blocks (248) through (258) may continue to be performed until an acceptable actual orientation of the second assembly is achieved.

Calculating the actuation time correction factor in block (264) may be achieved in any suitable manner. In some embodiments, the actuation time correction factor may be calculated using techniques known in the art of control systems.

In some embodiments, the actuation time correction factor may be calculated as a percentage of the difference between the updated actual orientation of the second assembly and the target orientation of the second assembly.

As a non-limiting example for illustrative purposes, the percentage may be 75 percent. As a further non-limiting example for illustrative purposes, if the updated actual orientation of the second assembly represents an "over-rotation" of 30 degrees relative to the target orientation, the actuation time correction factor may be calculated as 75 percent of 30 degrees (i.e., 22.5 degrees), and the predicted actuation time for the next iteration of blocks (248) through (258) may be reduced so that the control device may be predicted to allow 22.5 degrees less relative rotation between the second assembly and the first assembly before being actuated to prevent rotation of the second assembly relative to the first assembly. As a further non-limiting example for illustrative purposes, if the actual orientation of the second assembly represents an "under-rotation" of 40 degrees relative to the target orientation, the actuation time correction factor may be calculated as 75 percent of 40 degrees (i.e., 30 degrees), and the predicted actuation time for the next iteration of blocks (248) through (258) may be increased so that the control device may be predicted to allow 30 degrees more relative rotation between the second assembly and the first assembly before being actuated to prevent rotation of the second assembly relative to the first assembly.

When utilized, the actuation time correction factor may be recalculated for each iteration of blocks (248) through (258), or the actuation time correction factor may be the same for more than one iteration.

Referring to FIG. 11, the second exemplary embodiment of the control device control method comprises:

(280) providing a force tending to cause rotation of the first assembly and the second assembly relative to each other;

(282) determining an actual orientation of the second assembly with the control device actuated to prevent rotation of the second assembly relative to the first assembly;

(284) comparing the actual orientation of the second assembly with a target orientation of the second assembly in order to determine if the actual orientation of the second assembly is acceptable;

(286) if the actual orientation of the second assembly is acceptable, maintaining the control device actuated to prevent rotation of the second assembly relative to the first assembly;

(288) if the actual orientation of the second assembly is not acceptable, actuating the control device to perform a control device actuation cycle, wherein the control device actuation cycle comprises first actuating the control device to allow rotation of the second assembly relative to the first assembly and second actuating the control device to prevent rotation of the second assembly relative to the first assembly;

(290) determining an updated actual orientation of the second assembly;

(292) comparing the updated actual orientation of the second assembly with the target orientation of the second assembly in order to determine if the updated actual orientation of the second assembly is acceptable;

(294) if the updated actual orientation of the second assembly is not acceptable, repeating blocks (288) through (292), using the updated actual orientation of the second assembly as the actual orientation of the second assembly; and (296) if the updated actual orientation of the second assembly is acceptable, maintaining the control device actuated to prevent rotation of the second assembly relative to the first assembly.

Referring to FIG. 13, the third exemplary embodiment of the control device control method comprises:

(310) providing a force tending to cause rotation of the first assembly and the second assembly relative to each other;

(312) determining an actual rotation rate of the second assembly relative to the first assembly at a current actuation of the control device;

(314) comparing the actual rotation rate of the second assembly relative to the first assembly with a target rotation rate of the second assembly relative to the first assembly in order to determine if the actual rotation rate of the second assembly relative to the first assembly is acceptable;

(316) if the actual rotation rate of the second assembly relative to the first assembly is acceptable, maintaining the current actuation of the control device;

(318) if the actual rotation rate of the second assembly relative to the first assembly is not acceptable, actuating the control device to an updated current actuation of the control device;

(320) determining an updated actual rotation rate of the second assembly relative to the first assembly at the updated current actuation of the control device;

(322) comparing the updated actual rotation rate of the second assembly relative to the first assembly with the target rotation rate of the second assembly relative to the first assembly in order to determine if the updated actual rotation rate of the second assembly relative to the first assembly is acceptable;

(324) if the updated actual rotation rate of the second assembly relative to the first assembly is not acceptable, repeating blocks (318) through (322), using the updated actual rotation rate of the second assembly relative to the first assembly as the actual rotation rate of the second assembly relative to the first assembly; and (326) if the updated actual rotation rate of the second assembly relative to the first assembly is acceptable, maintaining the updated current actuation of the control device.

In performing the first exemplary embodiment of the control device control method, repeating blocks (248) through (258) as provided for in block (260) may be performed as a series of iterations until an acceptable actual orientation of the second assembly is achieved. Similarly, in the second exemplary embodiment of the control device control method, repeating blocks (288) through (292) as provided for in block (294) may be performed as a series of iterations until an acceptable actual orientation of the second assembly is achieved. Similarly, in the third exemplary embodiment of the control device control method, repeating blocks (318) through (322) may be performed as a series of iterations until an acceptable actual rotation rate of the second assembly relative to the first assembly is achieved.

In performing the control device control method, providing the force in blocks (240), (280) and (310) may be achieved in any suitable manner. In some embodiments, the force may be provided by reactive torque resulting from the operation of a drilling motor which may be associated with the second assembly. In some embodiments, the force may be provided by friction between the first assembly and the second assembly at the orientable rotatable connection, such as may be experienced if the first assembly is a drilling string and the second assembly is a sleeve rotatably connected with the first assembly. In some embodiments, the force may be provided directly to the first assembly and/or the second assembly by a source such as fluid pressure, a motor, a pump, etc.

In performing the control device control method, the control device may be comprised of any structure, device or apparatus or combination of structures, devices or apparatus which is capable of being actuated to selectively allow rotation of the second assembly relative to the first assembly or prevent rotation of the second assembly relative to the first assembly. Without limiting the generality of the foregoing, the control device may be comprised of a mechanical device, an hydraulic device, an electrical device, and/or a combination of mechanical, hydraulic and/or electrical devices.

As non-limiting examples, the control device may be comprised of a device such as those described in U.S. Pat. No. 5,485,889 (Gray), U.S. Pat. No. 6,059,050 (Gray) or U.S. Pat. App. Pub. No. US 2003/0056963 A1 (Wenzel), and/or those devices which are described above in connection with the apparatus (20).

Actuating the control device as contemplated in blocks (248), (254), (288) and (318) may be achieved in any suitable manner which is facilitated by the selected control device. It may be advantageous if the control device is capable of being actuated quickly and positively so that the control device control method may achieve the target orientation of the lower assembly or the target rotation rate of the second assembly relative to the first assembly efficiently, effectively and relatively quickly without excessive iteration.

In some embodiments, the control device may be comprised of an hydraulic circuit of the type depicted in FIG. 6. In such embodiments, the actuation of the control device may be enhanced by maintaining the first valve (134) and the second valve (136) in a closed position until it is necessary to actuate the control device to prevent rotation of the second assembly relative to the first assembly. Maintaining the first valve (134) and the second valve (136) in a closed position will facilitate pressurization by the pump (110) of the pumping fluid (114) in the first manifold line (214). The first valve (134) may then be opened to facilitate pressurization of the brake actuation line (220) and the brake pressure line (222) rapidly and thus actuate the brake (122) and the control device to prevent rotation of the second assembly relative to the first assembly. Once the brake actuation line (220) and the brake pressure line (222) are pressurized, the first valve (134) may be closed in order to trap the pumping fluid (114) between the valves (134,136) and thus maintain the pressure in the brake actuation line (220) and the brake pressure line (222).

In some embodiments, the control device may be comprised of an hydraulic circuit of the type depicted in FIG. 5. In such embodiments, the control device may be actuated quickly and positively by selectively opening and closing the valve (120).

One potential advantage of the hydraulic circuit depicted in FIG. 5 over the hydraulic circuit depicted in FIG. 6 is that the hydraulic circuit of FIG. 5 does not include a brake, clutch or similar structure which could be subject to wear and corresponding debris generation. Another potential advantage of the hydraulic circuit depicted in FIG. 5 over the hydraulic circuit depicted in FIG. 6 is that the relative rotation of the second assembly and the first assembly may be easier to control using the hydraulic circuit depicted in FIG. 5 if the force tending to cause rotation of the first assembly and the second assembly relative to each other is erratic (as may be the case if the force is provided by reactive torque).

In some embodiments, the control device may be comprised of a hydraulic circuit similar to the hydraulic circuit depicted in FIG. 5, the pumping fluid (114) may be comprised of or may consist essentially of a magnetorheological fluid, and the control device may be further comprised of a source of a varying magnetic field (not shown) so that the viscosity of the pumping fluid (114) and thus the pumping resistance (116) in the loop (112) can be varied with the magnetic field in order to actuate the control device. In some embodiments, the source of the varying magnetic field may be controlled by a controller such as the reactive torque control device controller (72) of the apparatus (20).

In the third exemplary embodiment of the control device control method, the control device is actuatable to one or more intermediate positions between a first position which allows relative rotation of the second assembly relative to the first assembly and a second position which prevents rotation of the second assembly relative to the first assembly. The intermediate positions permit the second assembly to rotate relative to the first assembly at rates which are slower than that permitted by the first position.

In the third exemplary embodiment of the control device control method, the target rotation rate of the second assembly relative to the first assembly may be managed in a similar manner as the target orientation rate in the first exemplary embodiment and the second exemplary embodiment of the method. For example, the apparatus may be operated in several different modes, including the fully automated closed-loop mode, the fully manual mode, and a variety of semi-automated closed-loop modes. A single target rotation rate of the second assembly relative to the first assembly or a sequence of target rotation rates may be used, and the single target rotation rate or a sequence of target rotation rates may be varied as a result of downlink instructions or as a result of data received from sensing devices associated with the apparatus in order to provide one or more updated target rotation rates.

In the first exemplary embodiment and the second exemplary embodiment of the control device control method, determining the actual orientations of the second assembly in blocks (242), (256), (282) and (290) may be achieved in any suitable manner. Without limiting the generality of the foregoing, the actual orientations may be determined using any of the apparatus and methods described above with respect to the apparatus (20).

More particularly, the actual orientations of the second assembly may be determined using an orientation sensing device (40) as described above with respect to the apparatus (20).

In the first exemplary embodiment of the control device control method, obtaining the rotational velocity indications in block (250) may be achieved in any suitable manner. Similarly, in the third exemplary embodiment of the control device control method, determining the actual rotation rates in blocks (312) and (320) may be achieved in any suitable manner. In some embodiments, the rotational velocity indications may be obtained and/or the rotation rates may be determined using data from an orientation sensing device (40) and/or one or more parameter sensing devices (98) such as those described above in connection with the apparatus (20).

The rotational velocity indications may be obtained and/or the rotation rates may be determined using one or more motion sensing devices (such as, for example, accelerometers) to provide a measurement of motion of the second assembly, using one or more sensing devices (such as, for example, counters) to provide a measurement of an amount of movement of the second assembly relative to the first assembly over a period of time, or in any other suitable manner. The rotational velocity indications and/or the rotation rates may be provided directly by the sensing devices, or the rotational velocity indications and/or the rotation rates may be calculated by a processor, including but not limited to a feedback processor (70) such as described above in connection with the apparatus (20), using data obtained from the sensing devices.

As described above with respect to the apparatus (20), the actual orientations of the second assembly may be determined using an orientation sensing device (40), which orientation sensing device (40) may be comprised of a sensor package and a referencing device (96), which referencing device may be comprised of a resolver. In such embodiments, the orientation sensing device (40) may be comprised of one or more sensors which are capable of directly or indirectly providing the rotational velocity indications and/or the rotation rates.

As a non-limiting example, a referencing device (96) comprising a resolver, such as the referencing device (96) described above for the apparatus (20), may be comprised of a sensing device for sensing movement of the second assembly relative to the first assembly. The sensing device may be comprised of a motion sensing device, a counter, or any other suitable structure, device or apparatus.

In some embodiments, a resolver may be comprised of a plurality of magnets associated with one of the first assembly and the second assembly and a counter associated with the other of the first assembly and the second assembly, so that the counter senses movement of the magnets past the counter in order to provide a measurement of an amount of movement of the second assembly relative to the first assembly. The amount of movement of the second assembly relative to the first assembly may be correlated with the time over which such movement occurs in order to provide the rotational velocity indications and/or the rotation rates.

As a result, in some embodiments of the first exemplary embodiment, determining the actual orientations of the second assembly in blocks (242) and (256) and obtaining the rotational velocity indications in block (250) may all be achieved using an orientation sensing device (40). Similarly, in some embodiments of the third exemplary embodiment, determining the actual rotation rates of the second assembly relative to the first assembly in blocks (312) and (320) may be achieved using an orientation sensing device (40).

In the first exemplary embodiment of the control device control method, calculating the predicted actuation time in block (252) may be performed in any suitable manner. Without limiting the generality of the foregoing, the predicted actuation time may be calculated having regard to the rotational velocity indication which is obtained in block (250), the actual orientation of the second assembly which is determined in block (242), the amount of rotation of the first assembly and the second assembly relative to each other which has occurred since the first actuating of the control device in block (248), the time required for the second actuating of the control device in block (254), the amount of force which is provided in block (240), and/or the actuation time correction factor which is calculated in block (264).

In some embodiments of the first exemplary embodiment, calculating the predicted actuation time in block (252) may be comprised of determining the rotational distance (i.e., angle) between the actual orientation determined in block (242) and the target orientation, subtracting the rotational distance travelled by the second assembly relative to the first assembly since the first actuating of the control device in block (248), subtracting the rotational distance which is expected to be travelled by the second assembly relative to the first assembly during the second actuating of the control device in block (254), and dividing the remaining rotational distance by the rotational velocity indication in order to calculate the predicted actuation time.

In some embodiments of the first exemplary embodiment, the rotational distance travelled by the second assembly relative to the first assembly since the first actuating of the control device in block (248) may be determined by referencing the actual orientation of the second assembly which is determined in block (242) to the amount of movement of the second assembly relative to the first assembly which occurs up to the time of initiation of the second actuating of the control device.

The rotational distance which is expected to be travelled by the second assembly relative to the first assembly during the second actuating of the control device in block (254) may be dependent upon variables including, but not limited to the amount of force which is provided in block (240), the rotational velocity of the second assembly relative to the first assembly at the initiation of the second actuating of the control device, and upon the characteristics of the control device, such as an amount of pumping resistance (116) which may be provide in a loop (112) in the apparatus (20) as described above and the amount of time which is required to actuate the control device.

In some embodiments of the first exemplary embodiment, the rotational distance which is expected to be travelled by the second assembly relative to the first assembly during the second actuating of the control device in block (254) may be determined by calculation based upon measurements from sensing devices or may be determined with reference to empirical data which may be stored in a memory such as a memory (148) which may be associated with a feedback control system (42).

As noted above, in some embodiments of the first exemplary embodiment, the resulting predicted actuation time may be adjusted by an actuation time correction factor which has been calculated in block (264).

The first exemplary embodiment of the control device control method may be most suited for use in circumstances in which the force provided in block (240) is relatively constant. One reason is because the rotational velocity indication assumes that the rotational velocity of the second assembly is constant between the first actuating of the control device and the second actuating of the control device. Another reason is because the time required to actuate the control device in block (254) may be dependent upon the amount of force which is provided in block (240).

In circumstances in which the force provided in block (240) is not relatively constant, an adjustment or correction may be made to the rotational velocity indication obtained in block (250) in order to reflect a varying rotational velocity, and/or an adjustment or correction may be made (using calculations and/or empirical data) to the distance which is expected to be travelled by the second assembly relative to the first assembly during the actuation of the control device in block (254) in order to reflect a varying force which is provided in block (240).

Comparing the actual orientations of the second assembly with the target orientation in blocks (244), (258), (284) and (292) may be achieved in any suitable manner. In some embodiments, the comparisons may be made using a processor, including but not limited to a feedback processor (70) such as described above in connection with the apparatus (20).

The determination in blocks (244), (258), (284) and (292) of whether the actual orientation of the second assembly is acceptable depends upon the degree of accuracy which is required with respect to the orientation of the second assembly. In some embodiments of the first exemplary embodiment and the second exemplary embodiment, no amount of difference between the actual orientation of the second assembly and the target orientation of the second assembly may be acceptable. In some embodiments of the first exemplary embodiment and the second exemplary embodiment, the actual orientation of the second assembly may be acceptable if it is within an acceptable orientation range relative to the target orientation, so that the actual orientation of the second assembly represents an acceptable variance of or an acceptable deviation from the target orientation.

In the first exemplary embodiment of the control device control method, block (248) through block (254) in FIG. 10 provide a control device actuation cycle. In the second exemplary embodiment of the control device control method, block (288) in FIG. 11 provides a control device actuation cycle. First actuating the control device and second actuating the control device to perform a control device actuation cycle in the first exemplary embodiment and the second exemplary embodiment may be achieved in any suitable manner which is facilitated by the control device.

A goal of the control device actuation cycle in the first exemplary embodiment is to achieve an acceptable actual orientation of the second assembly each time that the control device actuation cycle is performed.

A goal of the control device actuation cycle in the second exemplary embodiment is to provide a relatively small amount of relative rotation between the second assembly and the first assembly so that the second assembly incrementally advances toward the target orientation with each control device actuation cycle which is performed.

In this regard, a distinction between the first exemplary embodiment of the control device control method and the second exemplary embodiment of the control device control method is that the first exemplary embodiment seeks to achieve the target orientation of the second assembly in a single control device actuation cycle as represented by block (248) to block (254) in FIG. 10, while the second exemplary embodiment seeks only to move toward the target orientation of the second assembly in a single control device actuation cycle represented by block (288) in FIG. 11. The first exemplary embodiment may therefore be considered to represent a "target approach" to achieving an acceptable actual orientation of the second assembly, while the second exemplary embodiment may be considered to represent an "incremental approach" to achieving an acceptable actual orientation of the second assembly.

In some applications in which the force provided in block (240) or block (280) is not relatively constant, the second exemplary embodiment may be capable of achieving an acceptable actual orientation of the second assembly more quickly and/or with fewer iterations than the first exemplary embodiment. A reason for this is that each of the control device actuation cycles in the second exemplary embodiment may be performed relatively more quickly than the control device actuation cycles in the first exemplary embodiment.

Figure 12:
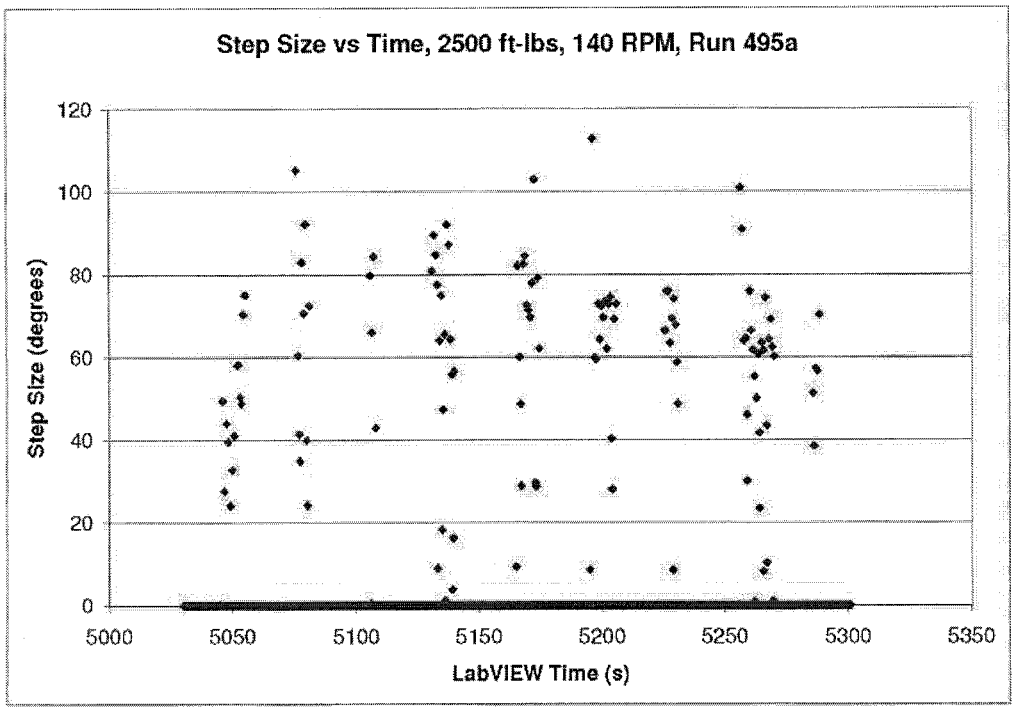
FIG. 12 is a graph of the amount of rotation in degrees of a second assembly relative to a first assembly in testing relating to the second exemplary embodiment of the control device control method as depicted in FIG. 11.

Referring to FIG. 12, a graph is provided of the amount of rotation in degrees of a second assembly relative to a first assembly in testing relating to the second exemplary embodiment of the control device control method as depicted in FIG. 11. In the testing which is the subject of FIG. 12, the force provided in block (280) was equivalent to 2500 foot pounds of torque and was provided by a drilling motor (30) associated with the second assembly which was operating at a speed of 140 revolutions per minute.

As indicated in FIG. 12, for a particular duration or length of a control device actuation cycle, the amount of rotation of the second assembly relative to the first assembly varied from about 0 degrees to about 115 degrees, with the most frequent amount of rotation being between about 40 degrees and about 80 degrees. FIG. 12 illustrates that for a particular length of a control device actuation cycle, the amount of rotation of the second assembly during the control device actuation cycle may fluctuate widely, even if the force provided in block (240) or block (280) of the method appears to be relatively constant.

In some embodiments of the second exemplary embodiment, each control device actuation cycle may be performed so that the amount of rotation of the second assembly relative to the first assembly which is provided in a single control device actuation cycle is less than or equal to the acceptable actuation range relative to the target orientation within which the actual orientation will be considered to be acceptable. This approach will ensure that the acceptable orientation range is not "overshot" by a single control device actuation cycle, but may be difficult to achieve if, as illustrated in FIG. 12, the amount of rotation of the second assembly relative to the first assembly in an individual control device actuation cycle is difficult to control.

In some embodiments of the second exemplary embodiment, it may therefore be more practical to attempt to limit the length of a control device actuation cycle in order to control the maximum amount of rotation of the second assembly relative to the first assembly which occurs in a single control device actuation cycle.

As a non-limiting example having regard to FIG. 12, in some embodiments of the second exemplary embodiment each control device actuation cycle represented by block (288) in FIG. 11 may be performed so that the length of each control device actuation cycle is sufficiently small so that the maximum amount of rotation of the second assembly relative to the first assembly which is provided in a single control device actuation cycle is no greater than about 120 degrees (i.e., about ⅓ of a single revolution).

Since many control device actuation cycles in a sample of control device actuation cycles will likely result in an amount of rotation of the second assembly relative to the first assembly which is significantly less than the maximum amount of rotation, as demonstrated in FIG. 12, controlling the maximum amount of rotation may be effective to enable an acceptable actual orientation of the second assembly to be achieved within a relatively small number of control device actuation cycles and within a relatively few revolutions of the second assembly relative to the first assembly.

The length of a control device actuation cycle which is required to achieve a desired amount of rotation of the second assembly relative to the first assembly in a control device actuation cycle may be dependent upon variables including, but not limited to the amount of force which is provided in block (280), the rotational velocity of the second assembly relative to the first assembly at the initiation of the second actuating of the control device, and upon the characteristics of the control device, such as an amount of pumping resistance (116) which may be provide in a loop (112) in the apparatus (20) as described above and the amount of time which is required to actuate the control device.

In general, the effectiveness of the second exemplary embodiment may be dependent upon the length of the control device actuation cycles and upon the resulting rotation of the second assembly relative to the first assembly in each control device actuation cycle, with the effectiveness of the second exemplary embodiment generally increasing as the length of the control device actuation cycles and the resulting rotation of the second assembly decreases.

In some embodiments, actuating the control device in the second exemplary embodiment to perform a control device actuation cycle may be comprised of first actuating the control device to allow rotation of the second assembly relative to the first assembly and thereafter second actuating the control device to prevent rotation of the second assembly relative to the first assembly immediately or at least quickly with a minimal delay in order to minimize the length of the control device actuation cycle and minimize the amount of rotation of the second assembly which occurs during the control device actuation cycle.

When any of the embodiments of the control device control method are used in conjunction with the apparatus (20) as described above, the control device control method may be used in any of the different modes of operation of the apparatus (20) for obtaining and/or maintaining a target orientation of the second assembly (i.e., the lower assembly (28)), including the fully automated closed-loop mode, the fully manual mode, and any of the possible semi-automated closed-loop modes.

In some embodiments, the control device control method may be implemented in a "target mode", in which a single target orientation of the second assembly is sought to be obtained and maintained until further instruction is received from the surface location (12) or from a feedback control system (42). In this target mode, an acceptable actual orientation of the second assembly can be achieved by the control device and can be maintained or reacquired if the actual orientation of the second assembly slips or drifts outside of the acceptable orientation range.

In some embodiments, the control device control method may be implemented in a "stepped mode", in which a sequence of target orientations of the second assembly is sought to be obtained and maintained over a particular time or drilling distance interval. In this stepped mode, a sequence of acceptable actual orientations of the second assembly can be achieved by the control device and can be maintained or reacquired if the actual orientation of the second assembly slips or drifts outside of the acceptable actuation range.

The stepped mode allows the control device to be maintained actuated to prevent rotation of the second assembly relative to the first assembly except when obtaining and reacquiring an acceptable actual orientation, while facilitating some periodic rotation of the second assembly relative to the first assembly. In some applications, the stepped mode of the control device control method may be preferred over an alternative of maintaining the control device actuated to allow rotation of the second assembly relative to the first assembly, because constant rotation may result in excessive wear of components of the orientable rotatable connection and/or the control device and because fluctuations in the force provided in block (240) in FIG. 10 or block (280) in FIG. 11 may also result in uncontrolled rotation of and damage to these components.

When the control device control method is implemented in the stepped mode, the series of target orientations may provide an orientation sequence or pattern which may be "biased" to facilitate directional drilling. As a non-limiting example, a series of target orientations (relative to the "high side" of the borehole) of 45 degrees, 90 degrees, 180 degrees, 270 degrees, 315 degrees, and 360 degrees would provide three "high side" target orientations (45 degrees, 315 degrees, 360 degrees), one "low side" target orientation (180 degrees), and two "neutral" target orientations (90 degrees, 270 degrees), which would tend to provide a build angle in the borehole.

In the third exemplary embodiment of the control device control method, comparing the actual rotation rates of the second assembly relative to the first assembly with the target rotation rate of the second assembly relative to the first assembly in blocks (314) and (320) may be achieved in any suitable manner. In some embodiments, the comparisons may be made using a processor, including but not limited to a feedback processor (70) such as described above in connection with the apparatus (20).

The determination in blocks (314) and (322) of whether the actual rotation rate of the second assembly is acceptable depends upon the degree of accuracy which is required with respect to the rotation rate of the second assembly relative to the first assembly. In some embodiments of the third exemplary embodiment, no amount of difference between the actual rotation rate and the target rotation rate may be acceptable. In some embodiments of the third exemplary embodiment, the actual rotation rate may be acceptable if it is within an acceptable rotation rate range relative to the target rotation rate, so that the actual rotation rate of the second assembly relative to the first assembly represents an acceptable variance of or an acceptable deviation from the target rotation rate.

In this document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The embodiments of the invention in which an exclusive property or privilege is claimed are defined as follows:

1. In an apparatus of the type comprising a first assembly, a second assembly, an orientable rotatable connection between the first assembly and the second assembly, and a control device associated with the orientable rotatable connection, a method for controlling the actuation of the control device, the method comprising:

(a) providing a force tending to cause rotation of the first assembly and the second assembly relative to each other;

(b) determining an actual orientation of the second assembly with the control device actuated to prevent rotation of the second assembly relative to the first assembly;

(c) comparing the actual orientation of the second assembly with a target orientation of the second assembly in order to determine if the actual orientation of the second assembly is acceptable;

(d) if the actual orientation of the second assembly is not acceptable, actuating the control device to perform a control device actuation cycle, wherein the control device actuation cycle comprises first actuating the control device to allow rotation of the second assembly relative to the first assembly and second actuating the control device to prevent rotation of the second assembly relative to the first assembly;

(e) determining an updated actual orientation of the second assembly;

(f) comparing the updated actual orientation of the second assembly with the target orientation of the second assembly in order to determine if the updated actual orientation of the second assembly is acceptable;

(g) if the updated actual orientation of the second assembly is not acceptable, repeating (d) through (f), using the updated actual orientation of the second assembly as the actual orientation of the second assembly; and (h) if the updated actual orientation of the second assembly is acceptable, maintaining the control device actuated to prevent rotation of the second assembly relative to the first assembly.

2. The method as claimed in claim 1 wherein actuating the control device to perform the control device actuation cycle is comprised of:

(i) first actuating the control device to allow the second assembly to rotate relative to the first assembly;

(ii) obtaining a rotational velocity indication of the second assembly relative to the first assembly;

(iii) calculating, using the rotational velocity indication, a predicted actuation time for actuating the control device to prevent rotation of the second assembly relative to the first assembly in order to achieve the target orientation of the second assembly; and (iv) second actuating the control device at the predicted actuation time to prevent rotation of the second assembly relative to the first assembly.

3. The method as claimed in claim 2, further comprising calculating an actuation time correction factor if the updated actual orientation of the second assembly is not acceptable, and further comprising using the actuation time correction factor in calculating the predicted actuation time if calculating the predicted actuation time is repeated.

4. The method as claimed in claim 3 wherein calculating the actuation time correction factor is comprised of calculating a percentage of a difference between the updated actual orientation of the second assembly and the target orientation of the second assembly.

5. The method as claimed in claim 2 wherein obtaining the rotational velocity indication is comprised of using a motion sensing device to provide a measurement of movement of the second assembly.

6. The method as claimed in claim 2 wherein obtaining the rotational velocity indication is comprised of using a referencing device to provide a measurement of an amount of movement of the second assembly relative to the first assembly.

7. The method as claimed in claim 6 wherein the referencing device is comprised of a plurality of magnets associated with one of the first assembly and the second assembly, wherein the referencing device is further comprised of a counter associated with the other of the first assembly and the second assembly, and wherein the counter senses movement of the magnets past the counter in order to provide the measurement of the amount of movement of the second assembly relative to the first assembly.

8. The method as claim 2 wherein calculating the predicted actuation time comprises:

(a) determining a rotational distance between the actual orientation of the second assembly and the target orientation;

(b) subtracting a rotational distance travelled by the second assembly relative to the first assembly since the first actuating of the control device;

(c) subtracting a rotational distance which is expected to be travelled by the second assembly relative to the first assembly during the second actuating of the control device; and (d) dividing a remaining rotational distance by the rotational velocity indication in order to calculate the predicted actuation time.

9. The method as claimed in claim 8, further comprising calculating an actuation time correction factor if the updated actual orientation of the second assembly is not acceptable, and further comprising using the actuation time correction factor in calculating the predicted actuation time if calculating the predicted actuation time is repeated.

10. The method as claimed in claim 9 wherein calculating the actuation time correction factor is comprised of calculating a percentage of a difference between the updated actual orientation of the second assembly and the target orientation of the second assembly.

11. The method as claimed in claim 2 wherein the actual orientation of the second assembly is acceptable if the actual orientation of the second assembly is within an acceptable orientation range relative to the target orientation.

12. The method as claimed in claim 2 wherein the updated actual orientation of the second assembly is acceptable if the updated actual orientation of the second assembly is within an acceptable orientation range relative to the target orientation.

13. The method as claimed in claim 2 wherein (d) through (f) are repeated until an acceptable actual orientation of the second assembly is achieved.

14. The method as claimed in claim 1 wherein actuating the control device in order to perform the control device actuation cycle is comprised of:

(a) first actuating the control device to allow rotation of the second assembly relative to the first assembly; and (b) second actuating the control device to prevent rotation of the second assembly relative to the first assembly;

wherein a length of the control device actuation cycle is selected so that a maximum amount of rotation of the second assembly relative to the first assembly during the control device actuation cycle is 120 degrees.

15. The method as claimed in claim 14 wherein (d) through (f) are repeated until an acceptable actual orientation of the second assembly is achieved.

16. The method as claimed in claim 1 wherein actuating the control device in order to perform the control device actuation cycle is comprised of:

(a) first actuating the control device to allow rotation of the second assembly relative to the first assembly; and (b) second actuating the control device to prevent rotation of the second assembly relative to the first assembly;

wherein second actuating the control device is performed immediately following first actuating the control device in order to minimize the rotation of the second assembly relative to the first assembly during the second actuating of the control device.

17. The method as claimed in claim 16 wherein (d) through (f) are repeated until an acceptable actual orientation of the second assembly is achieved.

18. The method as claimed in claim 1 wherein the control device is comprised of an hydraulic circuit.

19. The method as claimed in claim 18 wherein the hydraulic circuit is comprised of a pump and wherein the pump is driven by relative rotation between the first assembly and the second assembly.

20. The method as claimed in claim 19 wherein the hydraulic circuit is further comprised of a loop containing a pumping fluid and wherein the relative rotation between the first assembly and the second assembly causes the pump to pump the pumping fluid around the loop.

21. The method as claimed in claim 20 wherein the loop may be selectively blocked in order to prevent the pumping fluid from being pumped around the loop by the pump.

22. The method as claimed in claim 21 wherein the hydraulic circuit is further comprised of a valve positioned in the loop and wherein the valve may be actuated between an open position and a closed position in which the loop is blocked in order to prevent the pumping fluid from being pumped around the loop by the pump.

23. The method as claimed in claim 20 wherein the hydraulic circuit is further comprised of a brake associated with the loop, wherein the brake is comprised of a first brake part associated with the first assembly and a second brake part associated with the second assembly, and wherein the brake is actuated by a fluid pressure in the loop.

24. The method as claimed in claim 23 wherein the first brake part and the second brake part are urged into engagement with each other as a result of the fluid pressure in the loop, thereby providing an engagement force between the first brake part and the second brake part which impedes the relative rotation between the first assembly and the second assembly, and wherein the engagement force between the first brake part and the second brake part increases as the fluid pressure in the loop increases.

25. The method as claimed in claim 24 wherein the hydraulic circuit is further comprised of a first valve positioned in the loop on an upstream side of the brake and a second valve positioned in the loop on a downstream side of the brake, and wherein the first valve and the second valve may each be actuated between an open position and a closed position in which the loop is blocked between the first valve and the second valve in order to maintain the engagement force between the first brake part and the second brake part.

26. The method as claimed in claim 25 wherein the hydraulic circuit is further comprised of a pressure relief bypass line positioned in the loop for bypassing the first valve and the second valve when the fluid pressure in the loop exceeds a bypass pressure as determined by the pressure relief bypass line.

27. The method as claimed in claim 26 wherein second actuating the control device to prevent rotation of the second assembly relative to the first assembly comprises:

(a) actuating the first valve and the second valve to the closed position;

(b) allowing the fluid pressure in the loop to increase;

(c) actuating the first valve to the open position so that the engagement force resulting from the fluid pressure in the loop is provided between the first brake part and the second brake part; and (d) actuating the first valve to the closed position in order to maintain the engagement force between the first brake part and the second brake part.

28. The method as claimed in claim 20 wherein the pumping fluid is a magnetorheological fluid and wherein the hydraulic circuit is further comprised of a source of a varying magnetic field for varying a pumping resistance in the loop.

29. The method as claimed in claim 1, further comprising sensing a parameter relating to the apparatus in order to generate data relating to the parameter, and communicating the data to a surface location by an uplink communication.

30. The method as claimed in claim 1, further comprising sensing a parameter relating to the apparatus in order to generate data relating to the parameter, and using the data to vary the target orientation of the second assembly in order to provide an updated target orientation of the second assembly.

31. The method as claimed in claim 1, wherein the target orientation of the second assembly is comprised of a sequence of target orientations of the second assembly.

32. The method as claimed in claim 31 wherein the apparatus is further comprised of a memory and wherein the sequence of target orientations of the second assembly is stored in the memory.

33. The method as claimed in claim 32, further comprising storing the sequence of target orientations in the memory when the apparatus is located at a surface location.

34. The method as claimed in claim 32, further comprising storing the sequence of target orientations in the memory when the apparatus is located in a borehole.

35. The method as claimed in claim 32, further comprising sensing a parameter relating to the apparatus in order to generate data relating to the parameter, and using the data to vary at least one of the target orientations in the sequence of target orientations to provide at least one updated target orientation.

36. The method as claimed in claim 1 wherein the second assembly is connected with a drilling assembly.

37. The method as claimed in claim 36 wherein the target orientation of the second assembly is referenced to a toolface orientation of the drilling assembly in order to facilitate directional drilling.

38. In an apparatus of the type comprising a first assembly, a second assembly, an orientable rotatable connection between the first assembly and the second assembly, and a control device associated with the orientable rotatable connection, a method for controlling the actuation of the control device, the method comprising:

(a) providing a force tending to cause rotation of the first assembly and the second assembly relative to each other;

(b) determining an actual rotation rate of the second assembly relative to the first assembly at a current actuation of the control device;

(c) comparing the actual rotation rate of the second assembly relative to the first assembly with a target rotation rate of the second assembly relative to the first assembly in order to determine if the actual rotation rate of the second assembly relative to the first assembly is acceptable;

(d) if the actual rotation rate of the second assembly relative to the first assembly is acceptable, maintaining the current actuation of the control device;

(e) if the actual rotation rate of the second assembly relative to the first assembly is not acceptable, actuating the control device to an updated current actuation of the control device;

(f) determining an updated actual rotation rate of the second assembly relative to the first assembly at the updated current actuation of the control device;

(g) comparing the updated actual rotation rate of the second assembly relative to the first assembly with the target rotation rate of the second assembly relative to the first assembly in order to determine if the updated actual rotation rate of the second assembly relative to the first assembly is acceptable;

(h) if the updated actual rotation rate of the second assembly relative to the first assembly is not acceptable, repeating (e) through (g), using the updated actual rotation rate of the second assembly relative to the first assembly as the actual rotation rate of the second assembly relative to the first assembly; and (i) if the updated actual rotation rate of the second assembly relative to the first assembly is acceptable, maintaining the updated current actuation of the control device.

39. The method as claimed in claim 38 wherein the second assembly is connected with a drilling assembly.

40. The method as claimed in claim 38 wherein (e) through (g) are repeated until an acceptable actual rotation rate of the second assembly relative to the first assembly is achieved.

* * * * *